US006293639B1

(12) United States Patent
Isamoto

(10) Patent No.: US 6,293,639 B1
(45) Date of Patent: Sep. 25, 2001

(54) INK-JET RECORDING APPARATUS

(75) Inventor: Hideyuki Isamoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/112,003

(22) Filed: Jul. 8, 1998

(30) Foreign Application Priority Data

Jul. 8, 1997 (JP) ..... 9-182414
Jun. 15, 1998 (JP) ..... 10-167422

(51) Int. Cl.[7] ..... B41J 29/38

(52) U.S. Cl. ..... 347/10; 347/11; 347/5; 347/9

(58) Field of Search ..... 347/10, 11, 5, 347/9, 14, 12, 15, 195

(56) References Cited

U.S. PATENT DOCUMENTS 4,937,590 * 6/1990 Robillard et al. ..... 347/195
5,510,816 * 4/1996 Hosono et al. ..... 347/10
5,767,871 * 6/1998 Imai ..... 347/10
5,936,644 * 8/1999 Ono et al. ..... 347/10

FOREIGN PATENT DOCUMENTS 0 349 812 1/1990 (EP) ..... B41J/2/355
WO 94/26522 11/1994 (WO) ..... B41J/2/045
WO 96/26073 8/1996 (WO) ..... B41J/2/36

OTHER PUBLICATIONS

Patent Abstracts of Japan, vol. 007, No. 159 (M–228) Jul. 13, 1983 & JP 58 067477 A (Yokogawa Denki Seisakusho KK) Apr. 22, 1983 *Abstract.

* cited by examiner

*Primary Examiner*—Huan Tran
*Assistant Examiner*—An H. Do
(74) *Attorney, Agent, or Firm*—Sughrue, Mion, Zinn, Macpeak & Seas, PLLC

(57) ABSTRACT

In an ink-jet printer, on the basis of the previous, current, and next drive conditions held in latch circuits 252, 253, and 254, an output control section 255 switches the current drive waveform to be supplied to a pressure generation device. Therefore, the vibrating state of a vibrating state or that of an ink meniscus can be optimized by the time the next expelling of ink is performed. Accordingly, there is no need for consumption of time to wait for the next expelling of ink until the vibration of the vibrating plate or that of meniscus subsides sufficiently, thus resulting in a reduction in time intervals between ink expelling operations and implementing high-speed printing operations.

19 Claims, 16 Drawing Sheets

| LATCH ③ | LATCH ② | LATCH ① | SELECTION OUTPUT NCHG2 |
|---|---|---|---|
| 0 | 0 | * | 0 |
| 1 | 0 | * | 1 |
| * | 1 | 1 | 1 |
| * | 1 | 0 | 0 |

| LATCH ③ | LATCH ② | LATCH ① | SELECTION OUTPUT NCHG3 |
|---|---|---|---|
| 1 | 0 | * | 0 |

COMMON DRIVE SIGNAL
Vnco
V1
V3
Vm
V2

DRIVE WAVEFORM t12
t13
t14
t15
t16
t18
t19
t21
t22
t23
t24
t25
t26
t28
t29
t31

INK-JET RECORDING APPARATUS

BACKGROUND OF THE INVENTION

1. Field of the Invention

The present invention relates to an ink-jet recording apparatus, and more particularly, to a technique for controlling the driving of an ink-jet head provided in an ink-jet recording apparatus.

2. Related Art

An ink-jet head which expels ink droplets by inducing variations in the volume of ink through use of a heating element has been known as an ink-jet head to be used with an ink-jet recording apparatus such as an ink-jet printer. Another known type of ink-jet head is one which expels ink droplets by changing the volume of an ink chamber (a pressure generation chamber) in communication with an ink nozzle. A vibrating plate is formed in part of a circumferential wall so as to become resiliently deformable in an outward direction relative to the surface of a circumferential wall with which an ink chamber is partitioned, as well as to correspond to one dot. Ink droplets are expelled expelled from the ink nozzle in communication with the ink chamber by application of a drive signal to a piezoelectric vibrator (or a pressure generating element) mounted on the vibrating plate to thereby vibrate the vibrating plate.

Of the foregoing ink-jet heads, an ink-jet head which expels ink droplets by changing the volume of the ink chamber through use of the piezoelectric vibrator is classified into known types, i.e., an ink-jet head of catapult-like expelling type and an ink-jet head of pressurized expelling type. In the ink-jet head of catapult-like expelling type, by actuation of a piezoelectric vibrator, a vibrating plate constituting part of the ink chamber is displaced beforehand in a direction in which positive pressure develops in the ink chamber as a result of a reduction in its volume. In this state, the vibrating plate is displaced in a direction in which negative pressure develops in the ink chamber as a result of an increase in its volume, as a result of which an ink meniscus is withdrawn into a discharge port. At the instant when the ink meniscus is withdrawn to the innermost position, the vibrating plate is displaced in the reverse direction, thus expelling an ink droplet from the ink nozzle.

In contrast, in the ink-jet head of pressurized expelling type, after having been displaced in a direction in which negative pressure develops in the ink chamber as a result of an increase in the volume of the ink chamber, the vibrating plate is displaced in a direction in which positive pressure develops in the ink chamber as a result of a decrease in the volume of the ink chamber the instant when the ink meniscus formed in the ink discharge port becomes stationary, thus expelling an ink droplet. To perform expelling operations such as those set forth, a drive control section applies, between electrodes of the piezoelectric vibrator, a drive signal Vnco having a waveform, such as that shown in FIG. 19A. In the drive signal Vnco, a period from time t21 to time t31 corresponds to one drive cycle. Immediately before commencement of a current drive operation (i.e., during a period from time t19 to time t21), the vibrating plate is displaced in a direction in which the volume of the ink chamber decreases, by application of a first drive voltage V1 to the piezoelectric vibrator. In a case where an ink droplet is expelled by means of the current driving operation, the voltage applied to the piezoelectric vibrator is changed from the first drive voltage V1 to a second drive voltage V2 during a period from time t21 to time t22, thus displacing the vibrating plate in a direction in which the volume of the ink chamber increases. This state is maintained for a period from time t22 to time t23. Subsequently, the voltage applied to the piezoelectric vibrator is changed from the second drive voltage V2 to a third drive voltage V3 during a period from time t23 to time t24, thus displacing the vibrating plate in a direction in which the volume of the ink chamber decreases. Such a state is maintained for a period from t24 to time t25, and an ink droplet is expelled from the ink nozzle. Subsequently, during a period from time t25 to time t26, the voltage applied to the piezoelectric vibrator is changed from the third drive voltage V3 to an intermediate voltage (Vm) between the first and second drive voltages V1 and V2 or between the third drive voltage V3 and the second drive voltage V2, to thereby displace the vibrating plate in a direction in which the volume of the ink chamber is increased to its intermediate level, thus interrupting the flow of ink by means of the ink discharge port. After expelling of ink, the voltage applied to the piezoelectric vibrator is maintained at an intermediate voltage Vm during a period from time t26 to time t28 without regard to whether or not ink is expelled during the next drive cycle, whereby the volume of the ink chamber is maintained at its intermediate level. Immediately before commencement of the next drive operation (during a period from time t28 to time t29), the voltage applied to the piezoelectric vibrator is changed from the intermediate voltage Vm to the first drive voltage V1, thus displacing the vibrating plate in a direction in which the volume of the ink chamber decreases. Such a state is maintained for a period from time t29 to time 31.

In contrast, in a case where the expelling of an ink droplet from the ink nozzle is suspended for the period of time corresponding to one dot during the current drive cycle, a drive signal Vnco having a waveform such as that shown in FIG. 19B is applied between the electrodes of the piezoelectric vibrator. Immediately before commencement of the current drive operation (during a period from time t18 to time t21), the vibrating plate is displaced in a direction in which the volume of the ink chamber decreases from its intermediate level by means of the first drive voltage V1, as in the case described by reference to FIG. 19A in which an ink droplet is expelled during the current drive operation. During a period from time t21 to time 31 at which the next drive operation is commenced, the volume of the ink chamber is maintained at a reduced value by application of the first drive voltage V1 to the piezoelectric vibrator.

Here, the first and third drive voltages V1 and V3 may be respectively set to different potentials or to an identical potential as in the case such as that shown in FIG. 19A.

However, in a case where each vibrating plate is driven as has been conventionally practiced, if the piezoelectric vibrator is driven according to print data without consideration of the result of a previous driving operation or of a drive history such as the next driving conditions, neither improvement of print quality nor higher speed operation can be accomplished.

Specifically, in order to expel ink droplets from an ink nozzle, the vibrating plate is displaced during a period from time t12 to time 13 during the previous drive cycle until the ink nozzle becomes prepared for a squiring operation. The vibrating plate is then displaced during a period from time t13 to time t14 in a direction in which the volume of the ink chamber decreases. The vibrating plate is further displaced during a period from time t13 to time t14 in a direction in which the volume of the ink chamber decreases. Subsequent1y, the vibrating plate is displaced during a period from time t15 to time t16 until the volume of the ink chamber reaches an intermediate value. As shown in FIG.

19C, the vibrating plate keeps oscillating even after time t16, and the ink meniscus also oscillates in the same manner. As shown in FIG. 19A, in such a case, if the expelling of the ink droplet is continually carried out, a stable driving operation can be ensured by bringing the movement of the piezoelectric vibrator into synchronization with the movements of the vibrating plate or the ink meniscus. Alternatively, in a state in which the vibration of the vibrating plate or the ink meniscus has become sufficiently stationary, the vibrating plate is displaced in a direction in which the volume of the ink chamber increases, by changing the voltage applied to the piezoelectric vibrator from the first drive voltage V1 to the second drive voltage V2. An ink droplet can be squired stably, so long as the volume of the ink chamber is reduced by changing the voltage applied to the piezoelectric vibrator from the second drive voltage V2 to the third drive voltage V3.

As shown in FIGS. 19B and 19C, after the ink droplet has been expelled during a period from t13 to t15, the volume of the ink chamber is held at an intermediate value for a period from time t16 to time t18. When the vibration of the vibrating plate or the ink meniscus attempts to subside, the vibrating plate is displaced during a period from time t18 to time t21 so as to reduce the volume of the ink chamber, thus resulting in a state in which the expelling of ink is suspended. In such a case, the vibration of the vibrating plate or the meniscus does not subside sufficiently during a period (i.e., a period from time t21 to t31) before the next drive cycle. As a result, the state of the vibrating plate or the ink meniscus during a period from time t29 to time t31 is different from a state in which the vibration of the vibrating plate or the ink meniscus has subsided sufficiently and different from a vibrating state in which ink droplets are expelled continually (i.e., a vibrating state during a period from time t19 to time 21 shown in FIG. 19C). This may result in inappropriate displacement of the vibrating plate or the ink meniscus when an ink droplet is expelled after the suspended state, thus rendering high-quality printing operations impossible. In order for an existing ink-jet printer to prevent a reduction in print quality, which would otherwise be cased by a difference in the state of the vibrating plate or the ink meniscus according to whether the ink droplets have been expelled or the expelling of an ink droplet has been suspended during the previous drive cycle, a sufficient time must be ensured as an interval between ink expelling operations until the vibration of the vibrating plate or the ink meniscus subsides. As a result, the exiting ink-jet printer cannot be expected to accomplish improved printing operations.

SUMMARY OF THE INVENTION

The object of the present invention is to realize an ink-jet recording apparatus capable of performing a high-speed printing operation by holding a vibration of a vibrating plate in a given state until the next ink expelling operation is commenced.

To achieve the foregoing object, according to the present invention, the present invention provides an ink-jet recording apparatus including a plurality of pressure generation chambers, a plurality of ink nozzles which are in communication with the individual pressure generation chambers, pressure generation elements which constrict the pressure generation chambers to thereby expel ink droplets from the ink nozzles in communication with the individual pressure generation chambers, and drive control means which controls the ink nozzles expelling ink droplets through application of a drive signal to the pressure generation elements, wherein the drive control means includes data hold means for holding the previous, current, and next drive conditions with regard to the pressure generation elements, and output control means which switches the current drive waveform to be supplied to the pressure generation elements, on the basis of the previous, current, and next drive conditions stored in the data hold means at the time of current driving of the pressure generation elements.

In the present invention, the output control means switches the current drive waveform to be supplied to the pressure generation elements on the basis of the previous, current, and next drive conditions stored in the data hold means. As a result, the vibrating state of the ink meniscus can be optimized by the time expelling of ink is commenced in the next drive cycle. Since expelling of ink can always be commenced in a stable state, there is no need for consumption of time to wait for next expelling of ink until the vibration of an ink meniscus subsides sufficiently. Therefore, time intervals between ink expelling operations can be reduced, thus implementing high-speed printing operations.

According to the present patent application, a second aspect of the present invention, the output control means switches, at a waveform of a signal to be applied to the pressure generation elements at the time of current drive operation, a waveform of a signal to be applied to the pressure generation elements for a predetermined period of time after completion of a previous drive operation on the basis of the previous and current drive conditions stored in the data hold means, as well as switching the current drive waveform to be supplied to the pressure generation elements with regard to the waveform of the signal applied to the pressure generation elements immediately before commencement of the next drive operation, on the basis of the previous and current drive conditions stored in the data hold means or on the basis of the current and next drive conditions stored in the data hold means. With such a configuration, in the current drive operation, switching can be made according to whether or not a drive waveform which dampens oscillation of the meniscus caused in the previous drive operation must be applied to the pressure generation elements for a predetermined period of time after completion of the previous drive operation, in consideration of the current drive conditions.

In short, if ink is not expelled during the current drive operation and ink is expelled in the previous drive operation, there is need to make preparations for the next drive operation by application of a drive waveform which dampens the vibration of the meniscus caused during the previous drive operation during the current drive operation. Further, according to the present invention, immediately before commencement of the next drive operation, the drive waveform can be switched during the current drive operation by a choice between consideration of the previous drive condition or consideration of the next drive condition according to the current drive condition. More specifically, if ink is not expelled during the current drive operation, on the basis of the previous drive condition a determination is made as to whether there has already been performed a drive operation for dampening the vibration of the meniscus or there is need to perform such an operation during the current drive operation because there has not yet been performed an operation for dampening the vibration of the meniscus. According to the result of such a determination, the current drive waveform can be switched. In contrast, if ink is expelled during the current drive operation, on the basis of the next drive conditions a determination is made as to whether there should be performed a drive operation for dampening the vibration of the meniscus after expelling of ink droplets because ink is not expelled during the next drive operation or the ink-jet head should be brought into such a state as to be able to expel ink because ink is expelled in the current and next operations. According to the result of such a determination, the current waveform can be switched.

According to the present invention, the output control means drives the pressure generation elements so as to increase the volume of the ink chamber while the volume of the pressure generation chamber is in a reduced state; driving the pressure generation elements so as to reduce the volume of the pressure generation chamber, thus causing ink nozzles to expel ink droplets; and driving the pressure generation elements so as to maintain the volume of the pressure generation chamber in an intermediate state, wherein in a case where ink is not expelled during the next drive With such a configuration, in a case where ink is expelled during the current drive operation and ink is not expelled during the next drive operation, a drive waveform which maintains the volume of the pressure generation chamber after expelling of ink is applied to the pressure generation elements as the drive waveform for dampening the vibration of the meniscus caused by squiring ink droplets, after expelling of ink droplets during the current drive operation. operation, a waveform signal which causes the volume of the pressure generation chamber to be maintained at the intermediate state is applied to the pressure generation elements during the current drive operation immediately before commencement of the next drive operation. More specifically, the volume of the pressure generation chamber is not brought into preparations for expelling ink droplets (or the volume of the pressure generation chamber is not reduced) during the next drive cycle. Accordingly, after expelling of ink droplets, there is not performed a drive operation for displacing a meniscus of ink, and hence the volume of the pressure generation chamber can be brought into a state in which the vibration of the meniscus subsides during the course of the current drive cycle.

According to the present invention, in a case where ink is expelled during the previous drive operation and ink is not expelled during the current drive operation, during the current operation the output control means applies to the pressure generation elements a signal having a waveform which maintains the volume of the pressure generation chamber in the intermediate state for a given period of time after completion of the previous drive operation. With such a configuration, the volume of the pressure generation chamber is continually maintained at an intermediate volume for the purpose of dampening the vibration of the meniscus of ink from the previous drive operation to the current drive operation after expelling of ink during the previous drive operation, thus enabling the vibration of a meniscus to subside sufficiently.

According to the present invention, in a case where ink is expelled during the previous drive operation and ink is not expelled during the current drive operation, during the current operation the output control means applies to the pressure generation elements a signal having a waveform which maintains the volume of the pressure generation chamber in the intermediate state for a given period of time after completion of the previous drive operation and diminishes the volume of the pressure generation chamber immediately before commencement of the next drive operation. With such a configuration, after expelling of ink in the previous drive operation the volume of the pressure generation chamber is continually maintained at an intermediate volume in the first half of the current drive cycle for the purpose of dampening the vibration of the meniscus of ink. Subsequently, the pressure generation chambers are prepared for the next drive operation; namely, the volume of the pressure generation chambers is reduced. Accordingly, even in a case where ink is not expelled under the current drive conditions and ink is expelled under the next drive conditions, ink droplets can be expelled in the next drive cycle in the same manner as they are continually expelled from the current drive cycle to the next drive cycle. Therefore, ink droplets can be expelled under stable conditions in the next drive cycle.

According to the present invention, in a case where ink is expelled during the current drive operation and ink is not expelled during the next drive operation, the output control means applies to the pressure generation elements a signal having a waveform which causes the volume of the pressure generation chamber to diminish immediately before commencement of the next drive operation. More specifically, in a case where ink is expelled under the current drive conditions, since the volume of the ink pressure chambers is in an intermediate state after expelling of ink, the pressure generation chambers are returned from the intermediate state to an initial state in which ink is expelled during the next drive operation; namely, a state in which the volume of the pressure generation chamber is reduced. Accordingly, during the current drive cycle the ink pressure chambers can be prepared for expelling ink droplets in the next drive cycle.

According to the present invention, there is provided the voltage applied to the pressure generation elements at the commencement of a drive operation during a drive cycle in order to reduce the volume of the pressure generation chambers equals the voltage applied in order to diminish the volume of the pressure generation chambers for the purpose of expelling ink droplets. The voltage applied to the pressure generation elements in order to reduce the volume of the pressure generation chambers at the commencement of the drive operation during the drive cycle may differ from the voltage applied to cause the volume of the pressure generation chamber to diminish for the purpose of expelling ink droplets. However, if these voltages equal, the number of power sources required to generate drive waveforms can be minimized.

According to the present invention, there is provided the output control means uses as a signal common among the individual pressure generation elements a timing signal for specifying timing at which to the pressure generation elements there is applied a signal for causing the volume of the pressure generation chambers to diminish and controls application of a signal which causes a reduction in the volume of the pressure generation chambers to the pressure generation elements according to whether or not the timing signal is selected. With such a configuration, even in a case where control is exercised for each pressure chamber as to whether the volume of the pressure generation chamber is diminished or maintained at an intermediate level, there is no need to generate a timing signal for each pressure generation element, thus alleviating a load exerted on the drive circuit.

According to the present invention, there is provided the pressure generation elements piezoelectric elements.

BRIEF DESCRIPTION OF THE DRAWINGS

In the accompanying drawings:

FIGS. 9(A)–(D) are schematic diagrams for explaining the feature of the drive control method for the ink jet printer shown in FIG. 1;

DETAILED DESCRIPTION OF THE PREFERRED EMBODIMENTS

An ink-jet printer (an ink-jet recording apparatus) to which the present invention is applied will now be described by reference to the accompanying drawings.

Figure 1:
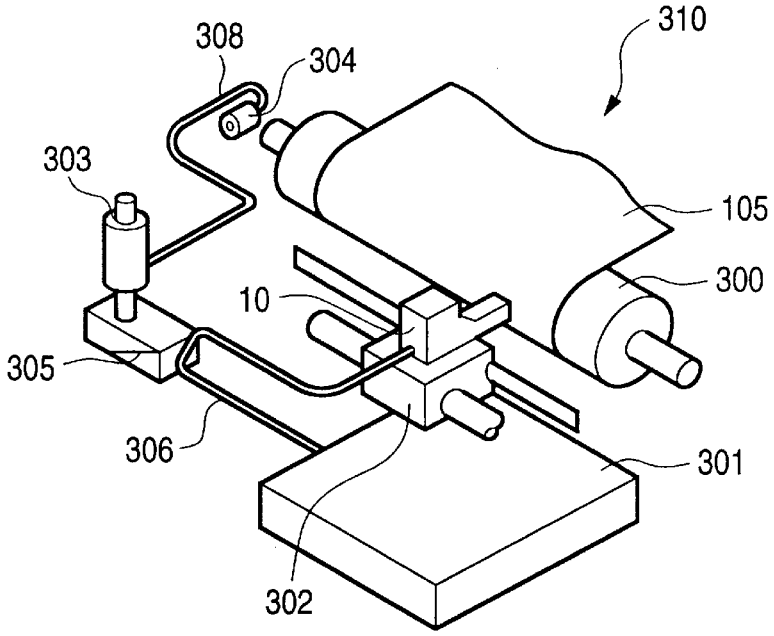
FIG. 1 is a schematic illustration showing a whole configuration of an ink jet printer of the present invention.

FIG. 1 is a view showing the outline of an ink-jet printer to which the present invention is applied. An ink-jet printer 310 according to the present embodiment has a common structure as a whole. More specifically, the ink-jet printer 310 comprises a platen roller 300 which is a constituent element of conveyor means for conveying recording paper 105; an ink-jet head 10 provided so as to oppose the platen roller 300; a carriage 302 which causes the ink-jet head 10 to travel back and forth in a line direction (or a primary scanning direction) corresponding to the axial direction of the platen roller 300; and an ink tank 301 which feeds ink to the ink-jet head 10 by way of an ink tube 306. In the drawing, reference numeral 303 designates a pump which is used to suck ink by way of a cap 304 and a wasted ink recovery tube 308 used in the event of an ink expelling failure occurring in the ink-jet head 10 as well as to collect the thus-sucked ink into a wasted ink reservoir 305.

Figure 2:
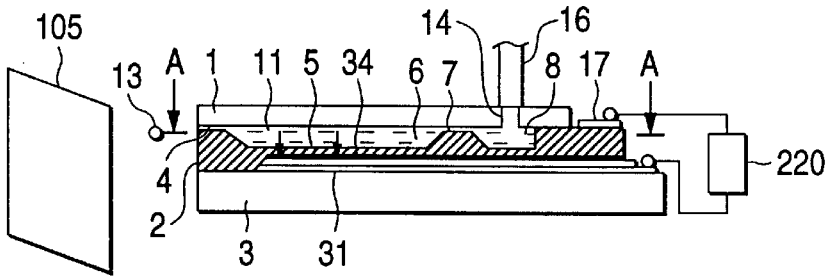
FIG. 2 is a schematic section view of an ink jet head mounted in the printer shown in FIG. 1.
Figure 3:
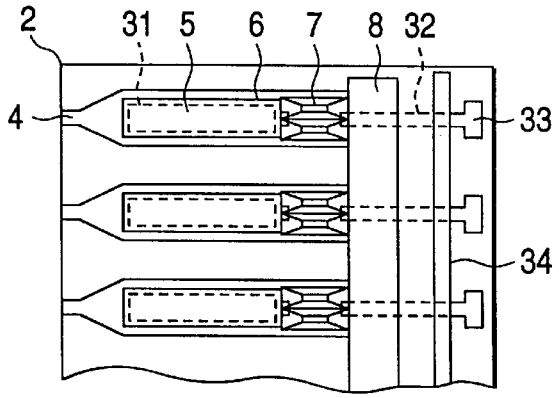
FIG. 3 is a plan view taken along the lines A—A shown in FIG. 2.

FIG. 2 is a cross-sectional view showing the ink-jet head 10, and FIG. 3 is a cross-sectional view taken along line A—A shown in FIG. 2.

The ink-jet head 10 according to the present embodiment utilizes a piezoelectric element (i.e., a piezoelectric vibrator) as a pressure generation element and changes the volume of an ink chamber (or the pressure generation chamber) in communication with a nozzle, wherein an ink droplet is expelled by means of a change in the pressure in the ink chamber. There may also be employed an ink-jet head which vibrates a vibrating plate by utilization of electrostatic force developing between electrodes to thereby change the volume of the ink chamber in communication with the nozzle, thus expelling an ink droplet.

Although the present embodiment adopts an ink-jet head of edge-eject type which expels an ink droplet from a nozzle hole formed in the edge of a substrate, there may also be employed an ink-jet head of face-eject type which expels an ink droplet from a nozzle hole formed in the upper surface of the substrate.

The structure of the ink-jet head 10 will be described by reference to FIGS. 2 and 3. The ink-jet head 10 according to the present embodiment has a laminated structure comprising three substrates 1, 2, and 3 superimposed on one another. The intermediate substrate 2 is, e.g., a silicon substrate. On the surface of the intermediate substrate 2 there are formed a plurality of nozzle channels which are arranged at equal pitches in parallel with one another along one edge of the surface of the intermediate substrate 2 so as to constitute a plurality of ink nozzles 4; indentations which are in communication with the individual nozzles 4 and are to constitute ink chambers 6 whose bottom walls serve as vibrating plates 5; narrow flutes which will constitute orifices 7 situated behind the indentations and which serve as ink inflow ports; and indentations which will constitute a common ink cavity 8 for the purpose of feeding ink to the individual ink chambers 6. A piezoelectric vibrator (not shown) is formed from a pair of electrodes (e.g., a first electrode and a second electrode) below the vibrating plate 5. The ink nozzles 4 are provided at a pitch of about 2 mm and are formed to a width of about 40 $\mu$m. A common electrode 17 (one of the electrodes of the piezoelectric vibrator) is formed on the upper surface of the intermediate substrate 2.

The upper substrate 1 bonded to the upper surface of the intermediate substrate 2 is formed from, e.g., glass or plastic. The plurality of ink nozzles 4, the ink chambers 6, the orifices 7, and the ink cavities 8 are formed by bonding the upper substrate 1 to the intermediate substrate 2. Ink supply ports 14 are formed in the upper substrate 1 so as to communicate with the individual ink cavities 8. The ink supply ports 14 are connected to the ink tank 301 by way of connection pipes 16 and a tube 306 (see FIG. 1).

The lower substrate 3 bonded to the lower surface of the intermediate substrate 2 is formed from, e.g., glass or plastic. An individual electrode 31 (the other electrode of the piezoelectric vibrator) is formed in each of the positions on the surface of the lower substrate 3 corresponding to the individual vibrating plates 5. The individual electrode 31 has a lead section 32 and a terminal 33. The electrode 31 and the lead section 32 other than the terminal 33 are coated with an insulating film 34. A lead wire (not shown) is bonded to each terminal 33.

In the ink-jet head 10 comprising the substrates stacked in the manner as mentioned previously, a driver 220 is connected between the common electrode 17 formed on the intermediate substrate 2 and the terminals 33 of the individual electrodes 31. Ink 11 is fed to the inside of the intermediate substrate 2 by way of the ink supply ports 14, thus filling the ink cavities 8 and the ink chambers 6. An interval between the electrode 31 and the vibrating plate 5 is kept to 1 $\mu$m or thereabouts. In FIG. 2, reference numeral 13 designates an ink droplet expelled from the nozzle hole 4.

Ink used with the foregoing ink-jet head is prepared by dissolving or dispersing a surfactant, such as ethylene glycol and dye or pigment, into the primary solvent, such as water, alcohol, or toluene. Hot melt ink may also be used, so long as the ink-jet head is equipped with a heater.

After the vibrating plate 5 has been deflected downward by application of a voltage pulse to the individual electrode 31 from the driver 220, the voltage pulse applied to the electrode 31 is turned off, whereby the vibrating plate 5 returns to its original position. As a result of such a returning action of the vibrating plate 5, the internal pressure within the ink chamber 6 upsurges, thus expelling the ink droplet 13 toward the recording paper 105 from the nozzle hole 4. As a result of downward deflection of the vibrating plate 5, the ink chamber 6 is replenished with the ink 11 from the ink cavity 8 by way of the orifice 7.

Figure 4:
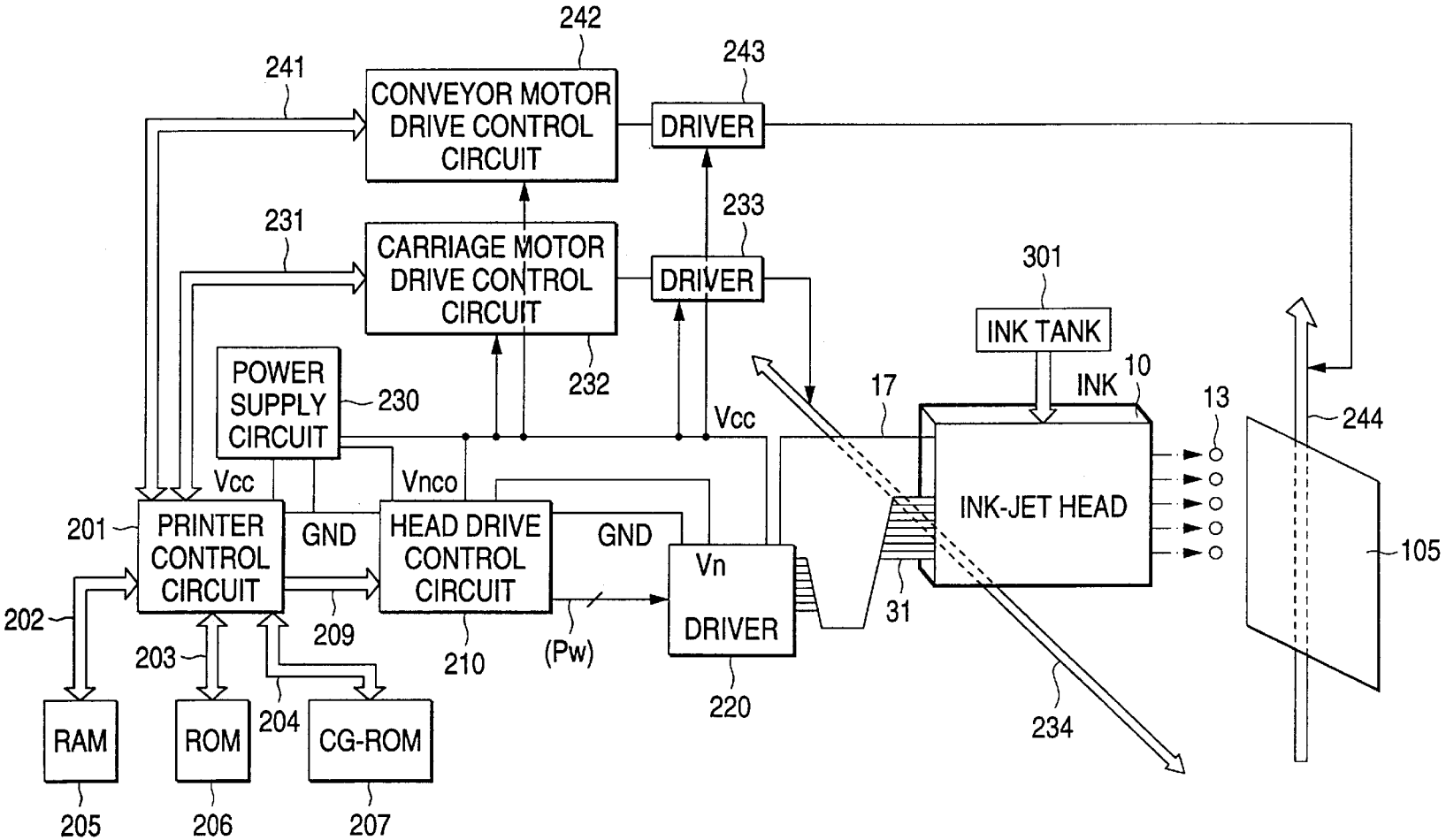
FIG. 4 is a schematic block diagram showing a control system for the ink jet head in the ink jet printer showin in FIG. 1.

FIG. 4 shows a control system of an ink-jet printer according to the present embodiment. Circuitry constituting the core of the control system may be formed from, e.g., a one-chip microcomputer. In the drawing, reference numeral 201 designates a printer control circuit. This printer control circuit 201 is connected to RAM 205, ROM 206, and a character generator ROM (CG-ROM) 207 by way of internal buses 202, 203, and 204 including an address bus and a data bus. A control program is stored beforehand in the ROM 206, and control operations of the ink-jet head 10, which will be described later, are executed according to the program invoked and started from the ROM 206. The RAM 205 is utilized as a working area during a drive control operation, and a dot pattern corresponding to an input character is de-archived in the CG-ROM 207.

Reference numeral 210 designates a head drive control circuit (i.e., drive control means) and is connected to the printer control circuit 201 by way of an internal bus 209. Under control of the printer control circuit 201, the head drive control circuit 210 outputs a drive signal and a clock signal to a head driver 220.

The head driver 220 comprises, e.g., a TTL array and causes an ink droplet to be expelled from a corresponding nozzle hole 4 by application of a drive signal Vnco to the individual electrode 31 and the common electrode 17 of the piezoelectric vibrator to be driven. To effect such a drive operation, the head drive 220 is provided with a ground potential GND and the common drive signal Vnco. These voltages are formed from a drive voltage Vcc of a supply circuit 230.

The printer control circuit 201 is connected to a carriage motor drive control circuit 232 by way of an internal bus 231. By way of a motor driver 233, a carriage motor drive control circuit 232 drives a carriage motor (not shown) for moving back and forth a carriage 302 which supports the ink-jet head 10, thus moving the ink-jet head 10 in a direction designated by arrow 234 in the drawing. The printer control circuit 201 is connected to a carrier motor drive control circuit 242 by way of an internal bus 241, and the carrier motor drive control circuit 242 drives a carrier motor (not shown) by way of a motor driver 243, thus feeding recording paper 302 along the platen roller 300 in a feed direction designated by arrow 244 shown in the drawing.

Figure 5:
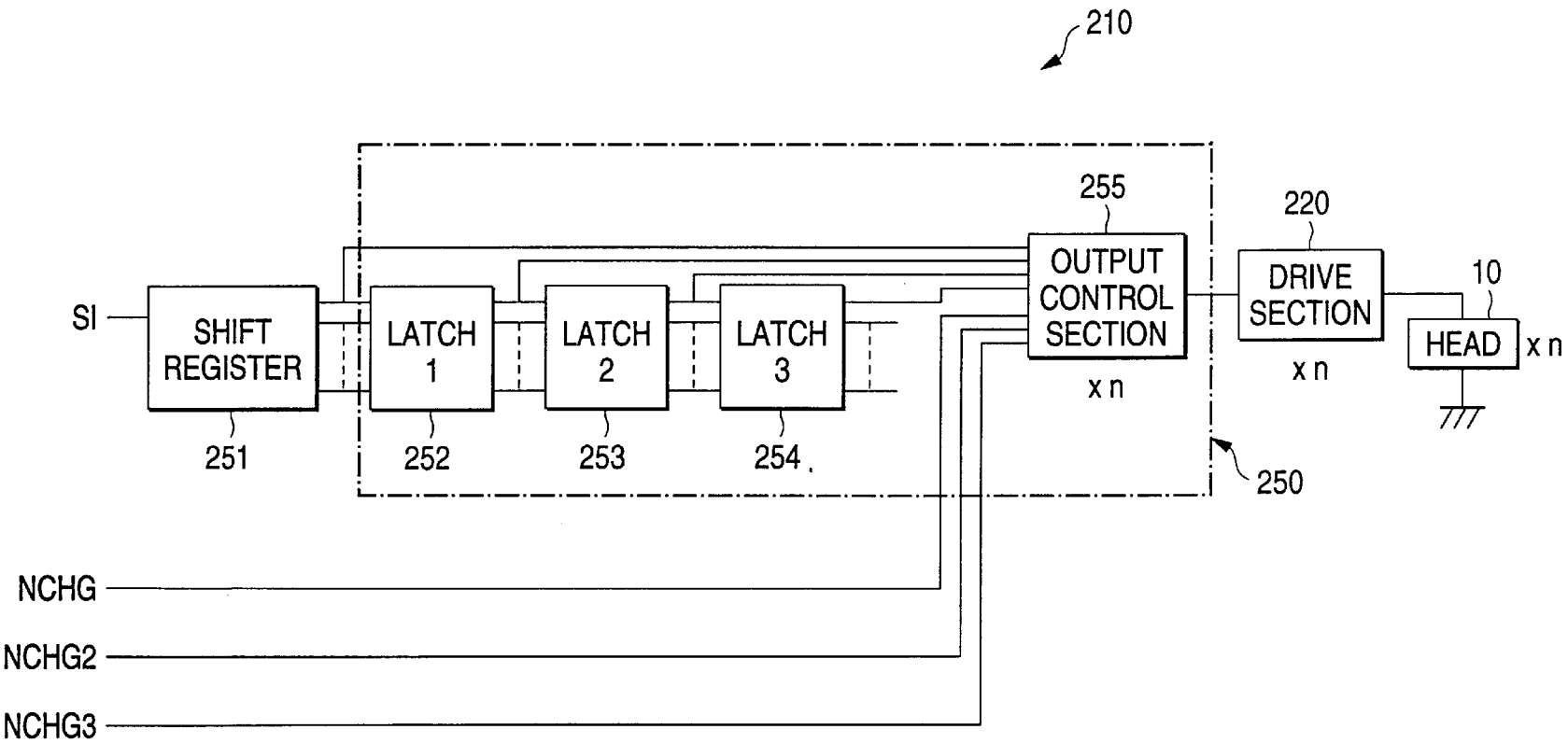
FIG. 5 is a block diagram showing a history control section constituted in the control system of the ink jet printer shown in FIG. 1.
Figure 6:
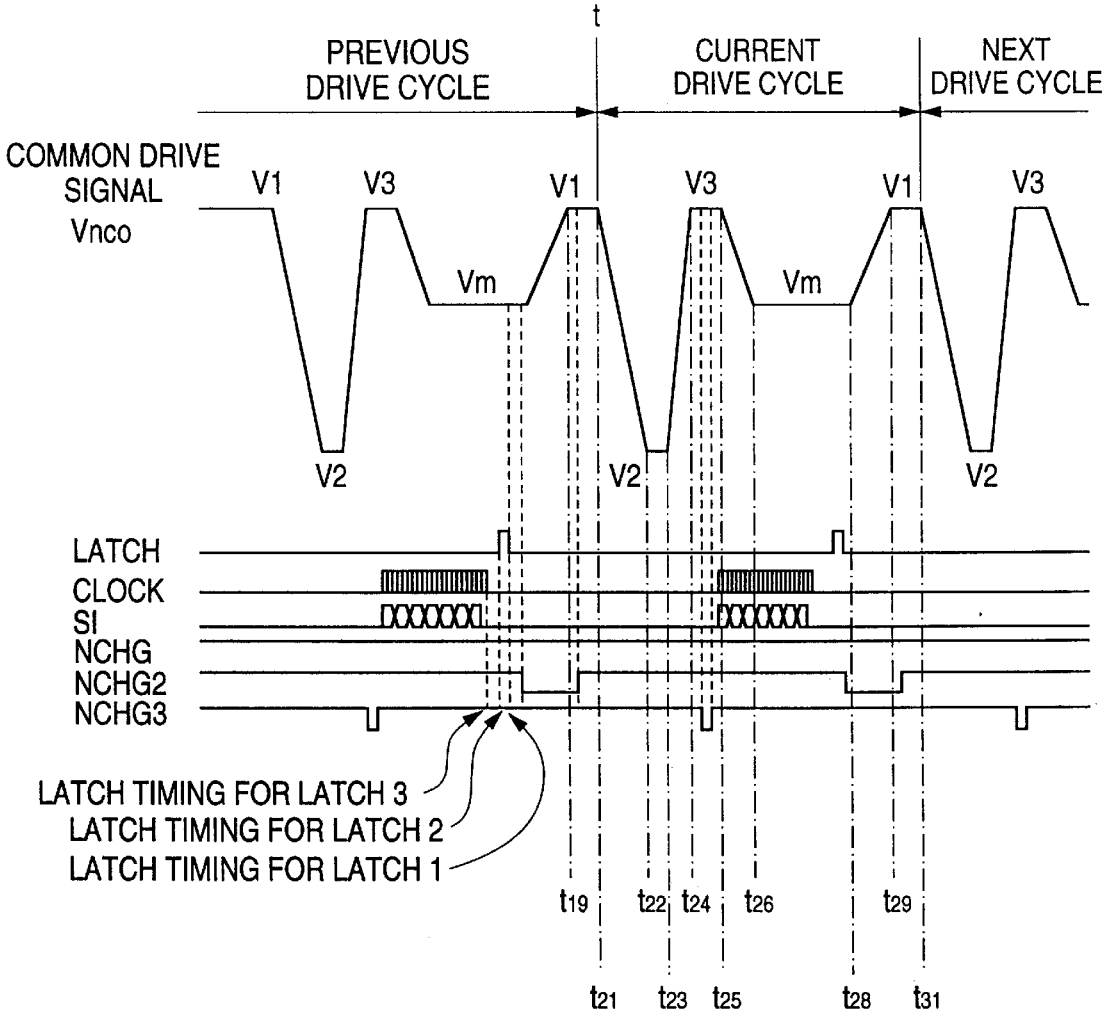
FIG. 6 shows wave forms of driving signals of the ink jet printer shown in FIG. 1.

In the control system having the foregoing configuration, as shown in FIG. 5, the head drive control circuit 210 comprises a shift register 254, a first latch circuit 252, a second latch circuit 253, a third latch circuit 254, and an output control circuit 255. The shift register 251 has a function of converting print data SI received in the form of a serial signal into Xn parallel print data sets which are equal in number to ink nozzles Xn. The first latch circuit 252 serves as data hold means which retains next print data for each ink nozzle (or vibrating plate); the second latch circuit 253 serves as data hold means which retains the current print data for each ink nozzle (or a vibrating plate); and the third latch circuit 254 serves as data hold means which retains the previous print data for each ink nozzle (or vibrating plate). On the basis of the data recorded and retained in each of the latch circuits, the output control circuit 255 outputs to the driver 220 (or a drive section) a drive signal corresponding to print data for each ink nozzle. More specifically, on the basis of the data retained in the first through third latch circuits 252 through 254, the output control section 255 selects charge signals NCHG, NCHG2, and NCHG3 input to the latch circuits, as required, thus outputting to the driver 220 (a drive section) a drive pulse signal PW (or electric potentials of the drive signal Vnco at the positions of the NCHG2 and NCHG3 pulse signals) to be applied to the electrodes of the piezoelectric vibrator. Accordingly, the first latch circuit 252, the second latch circuit 253, the third latch circuit 254, and the output control section 255 are said to constitute a history control section 250 which switches between drive conditions according to the data recorded or retained in the individual latch circuits. As shown in FIG. 6, the third latch circuit 254 transfers data in association with the trailing edge of a clock signal CLOCK; the second latch circuit 253 transfers data in association with the leading edge of a latch signal LATCH; and the first latch circuit 252 transfers data in association with the trailing edge of the latch signal LATCH.

As shown in FIG. 6, in the case of the drive signal Vnco (common) used with the ink-jet printer according to the present embodiment, a period of the signal from time t21 to time t31 corresponds to one drive cycle. With regard to the drive signal Vnco, immediately before commencement of a current drive operation (during a period from time t19 to time t20), the vibrating plate is displaced in a direction in which the volume of the ink chamber decreases, by application of the first drive voltage V1 to the piezoelectric vibrator. In a case where an ink droplet is expelled during the current drive operation, the voltage applied to the piezoelectric vibrator is changed from the first drive voltage V1 to the second drive voltage V2 during a period from time t21 to time t22, thus displacing the vibrating plate in a direction in which the volume of the ink chamber increases. Such a state is maintained for a period from time t22 to time 23. Next, the voltage applied to the piezoelectric vibrator is changed from the second drive voltage V2 to the third drive voltage V3 during a period from time t23 to time t24, thus displacing the vibrating plate in a direction in which the volume of the ink chamber decreases. Such a state is maintained for a period from time t24 to time t25, thus expelling an ink droplet from the ink nozzle. Subsequently, the voltage applied to the piezoelectric vibrator is changed from the third drive voltage V3 to an intermediate voltage (Vm) between the first and second drive voltages V1 and V2 or between the third drive voltage V3 and the second drive voltage V2 during a period from time t25 to time t26 to thus displace the vibrating plate in a direction in which the volume of the ink chamber reaches an intermediate level, thereby interrupting the flow of ink in the ink nozzle opening. After expelling of ink, the voltage applied to the piezoelectric vibrator is held at the intermediate voltage Vm during a period from time t26 to time t28, thus holding the volume of the ink chamber to an intermediate value. Immediately before commencement of the next drive operation (during a period from time t28 to time t29), the voltage applied to the piezoelectric vibrator is changed from the intermediate voltage Vm to the first drive voltage V1, thus displacing the vibrating plate in a direction in which the volume of the ink chamber decreases. Such a state is held for a period from time t29 to time t30.

In the present embodiment, as a result of the first and third drive voltages V1 and V3 being set equal, the number of power supplies required to generate the drive signal Vnco is minimized. However, the present invention can also be applied to a case where different voltages are used for the first and third drive voltages.

In the ink-jet printer (or ink-jet recording apparatus) having the foregoing configuration, at the time of suspension of expelling of the ink droplet 13 from the ink nozzle 4, the output control section 255 selects the charge signal NCHG2 or the charge signal NCHG3 (or timing signal) on the basis of the data latched in the first through third latch circuits 252 to 254 (i.e., the previous, current, and next driving conditions) or on the basis of the data recorded and latched in the latch circuits under given conditions. The output control section 255 acquires a given voltage from the drive signal Vnco at timing corresponding to the thus-selected charge signal and determines whether to apply the voltage to the piezoelectric vibrator. For example, in a case where the third voltage V3 which causes the vibrating plate to be displaced in a direction in which the volume of the ink chamber decreases is applied to the piezoelectric vibrator at timing corresponding to a period from time t24 to t25, the output control section 255 selects the charge signal NCHG3. In contrast, if the charge signal NCHG3 is not selected, the third drive voltage V3 is not applied between the electrodes of the piezoelectric vibrator at timing corresponding to a period from time t24 to time t25, and hence the volume of the ink chamber is maintained at the current value. In a case where the first voltage V1 which causes the vibrating plate to be displaced in a direction in which the volume of the ink chamber decreases is applied to the piezoelectric vibrator at timing substantially corresponding to a period from time t28 to time t29 under given conditions, the output control section 255 selects the charge signal NCHG2.

Figure 7:
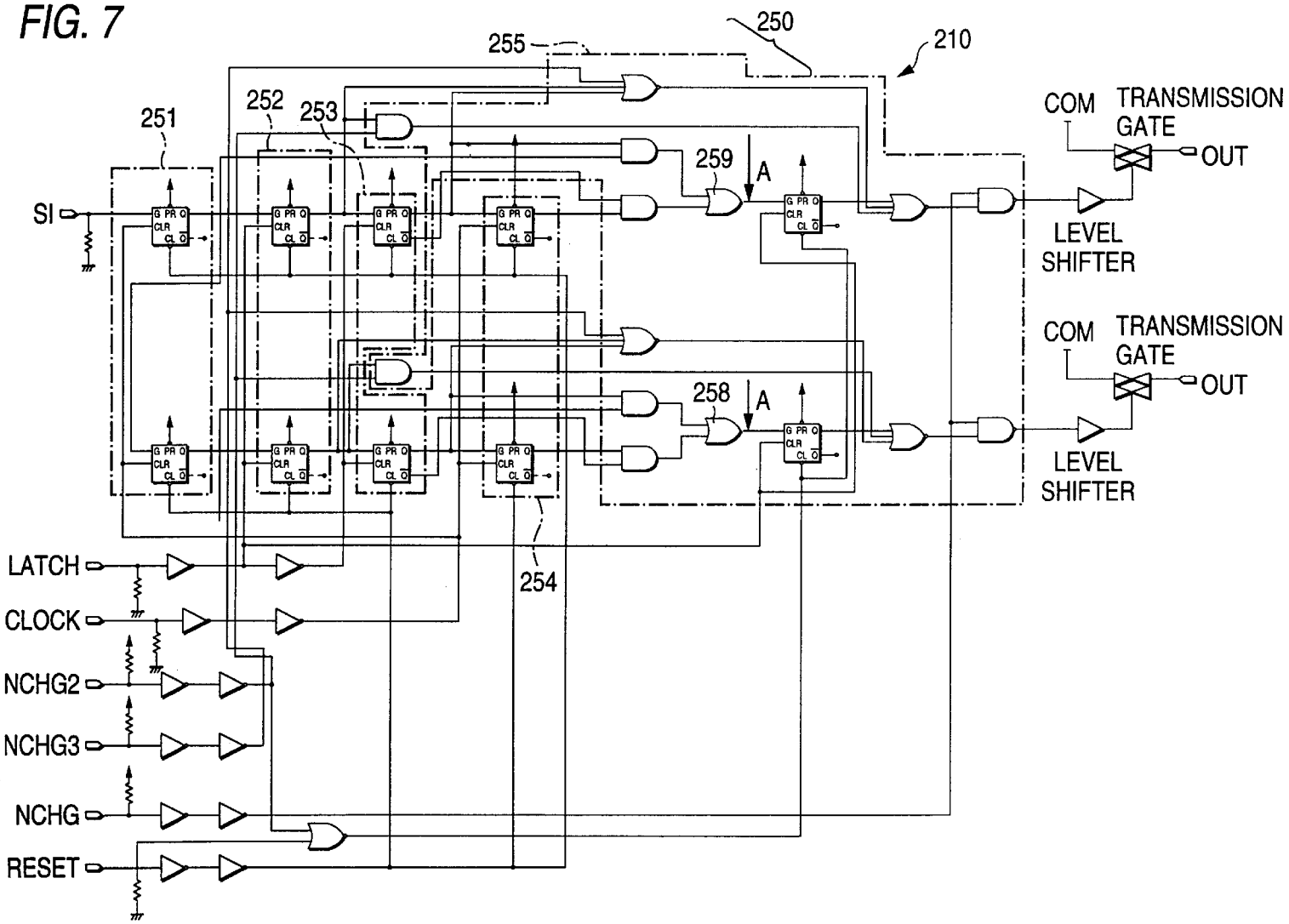
FIG. 7 shows a logic circuit for constituting the history control section shown in FIG. 5.

As shown in FIG. 7, the head drive control circuit 210 comprises flip-flops, AND gates, and OR gates so as to enable the output control section 255 to switch the drive waveforms for each ink nozzle, on the basis of the data recorded and latched in the latch circuits 252, 253, and 254. The output control section 255 operates in the manner as described in a logic truth table shown in FIGS. 8A and 8B.

As shown in FIG. 7, in the head drive control circuit 210, for each of Xn ink nozzles four cascaded flip-flops constitute a shift register 251, a first latch circuit 252, a second latch circuit 253, and a third latch circuit 254. The print data SI input to the shift register 251 in the form of a serial signal are converted into Xn print data sets equal in number to the Xn ink nozzles. The thus-converted parallel data sets are maintained in the first latch circuits 252 corresponding to the individual ink nozzles. The thus-maintained data sets are sequentially transferred to the second latch circuit 253 and the third latch circuit 254. The first latch circuit 252 maintains the next print data for each ink nozzle (vibrating plate); the second latch circuit 253 maintains the current print data for each ink nozzle (vibrating plate); and the third latch circuit 254 maintains the previous print data for each ink nozzle (vibrating plate).

To realize the foregoing operations, the control signal of the charge signal NCHG3 is first transferred to the shift register 251, where the signal is latched. Next, the control signal of the charge signal NCHG2 is transferred to the shift register 251, where the signal is latched. At this time, the control signal of the charge NCHG3 is latched into the second latch circuit 253. Subsequently, the print data SI are transferred to the shift register 251, where the data are latched. At this time, the control signal of the charge signal NCHG2 is latched into the second latch circuit 253, and the control signal of the NCHG3 is latched into the third latch circuit 254. As a result, historical control of drive conditions is carried out by means of the charge signals NCHG2 and NCHG3.

As has already been described by reference to FIG. 6, the third latch circuit 254, the second latch circuit 253, and the first latch circuit 251 transfer data in association with the trailing edge of the clock signal CLOCK, the leading edge of the latch signal LATCH, and the trailing edge of the latch signal LATCH, respectively.

Figure 8:
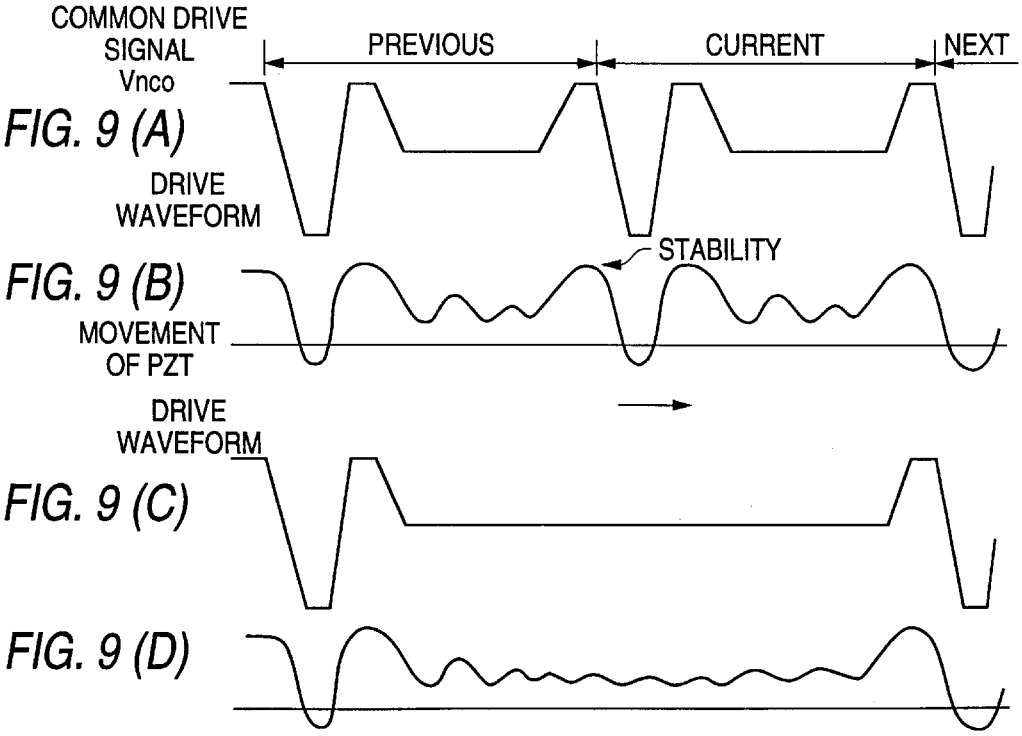
FIGS. 8(A)–(B) are logic truth tables for explaining the operation of the logic circuit shown in FIG. 6.

The output control section 255 comprises gate circuits and selects either the charge signal NCHG2 or the charge signal NCHG3 in the manner as described in the logic truth table shown in FIG. 8, on the basis of the first through third latch circuits 252, 253, and 254.

FIGS. 8A and 8B are logic truth tables on the basis of which the selection of the charge signal NCHG2 or the charge signal NCHG3 is determined. In these drawings, the contents of the data latched in the first circuit 252, those of the data latched in the second latch circuit 253, and those of the data latched in the third latch circuit 254 are expressed as latch (1) (the next drive conditions), latch (2) (the current drive conditions), and latch (3) (the previous drive conditions). Of the binary signals described in the columns for latch (1), latch (2), and latch (3), a logic value of "1" signifies expelling of ink during the drive cycle; and a logic value of "0" signifies no expelling of ink during the drive cycle. In FIG. 8A, a logic value of "1" provided in the column of selection output of the charge signal NCHG2 signifies extraction of a waveform which changes from the intermediate voltage Vm to the first drive voltage V1 from the drive signal Vnco (common) and application of the thus-extracted waveform to the piezoelectric vibrator by selection of the charge signal NCHG2 at the timing corresponding to the charge signal NCHG2. In FIG. 8B, a logic value of "1" provided in the column of selection output of the charge signal NCHG3 signifies extraction of the third drive voltage V3 from the drive signal Vnco (common) and application of the thus-extracted drive voltage to the piezoelectric vibrator by selection of the charge signal NCHG3 at the timing corresponding to the charge signal NCHG3. In contrast, a logic value of "0" provided in the column signifies no selection of the charge signal NCHG3. Accordingly, the logical "0" signifies no extraction of the third drive voltage V3 even at the timing corresponding to the charge signal NCHG3.

As shown in FIG. 8A, according to the logic truth table comprising the foregoing descriptions, a determination is made as to whether or not the charge signal NCHG3 is selected, on the basis of the previous and current drive conditions as well as on the basis of the current and next drive conditions.

More specifically, if the current drive conditions has no expelling of ink [i.e., a logic value of "0" in latch (2)], the charge signal NCHG2 represents a logic value of "0" without regard to the next drive condition [i.e., "*" in latch (1)], so long as the previous drive condition includes no expelling of ink [a logic value of "0" in latch (3)]. In contrast, if the previous drive condition includes the expelling of ink [i.e., a logic value of "1" in latch (3)], the charge signal NCHG2 represents a logic value of "1."

In contrast, in a case where the current drive condition includes expelling of ink [i.e., a logic value of "1" in latch (2)], the charge signal NCHG2 represents a logic value of "1" without regard to the previous drive condition [i.e., "*" in latch (3)], so long as the next drive condition includes expelling of ink [i.e., a logic value of "1" in latch (1)]. In contrast, if the next drive condition does not include expelling of ink [i.e., a logic value of "0" in latch (1)], the charge signal NCHG2 represents a logic value of "0." However, in the present embodiment, in a case where the current drive condition includes expelling of ink [i.e., a logic value of "1" in latch (2)], the ink-jet printer is driven by means of the drive signal Vnco. Accordingly, the selection output from the charge signal NCHG2 may be a logic value of "0."

Further, as shown in FIG. 8B, a determination is made as to whether or not the charge signal NCHG3 is selected on the basis of the previous and current drive conditions. More specifically, in a case where the previous drive condition includes the expelling of ink [i.e., a logic value of "1" in latch (3)] and the current drive condition does not include the expelling of ink [i.e., a logic value of "0" in latch (2)], the charge signal NCHG3 is not selected without regard to the next drive condition [i.e., "*" in latch (1)]. Accordingly, the third drive voltage V3 is not applied to the piezoelectric vibrator during the current drive operation. Since the charge signal NCHG3 is selected under the other conditions, the third drive voltage V3 is applied to the electrodes of the piezoelectric vibrator during the current drive operation.

As shown in FIG. 9A to FIG. 15, with the foregoing condition settings, in a case where ink is continually expelled, the intermediate voltage Vm is applied to the piezoelectric vibrator for a predetermined period of time in any drive cycle after expelling of ink droplets. Immediately before the next drive cycle, the voltage applied to the piezoelectric vibrator changes from the intermediate voltage Vm to the first drive voltage V1, thus reducing the volume of the ink chamber. More specifically, during the current drive cycle, preparations are made for expelling ink during the next drive cycle. Accordingly, in a case where an attempt is made to expel ink droplets in the next drive cycle, the vibrating plate (or the meniscus of ink) is in a vibrating state such as that shown in FIG. 9B. In such a stable vibrating state, a stable drive operation can be ensured by bringing the movement of the piezoelectric vibrator in synchronization with the movement of the vibrating plate or the meniscus even if the vibration of the vibrating plate or the meniscus does not subside sufficiently.

As shown in FIG. 9C to FIG. 13, even when the expelling of ink is suspended during the cycle of expelling ink, e.g., the case of suspension of expelling of ink during the course of expelling ink, the intermediate voltage Vm is applied to the piezoelectric vibrator after expelling of ink droplets during the previous drive cycle. Subsequently, the intermediate voltage Vm is applied to the piezoelectric vibrator even during the current drive cycle for a given period of time after completion of the previous drive cycle. Accordingly, the state immediately after expelling of ink droplets (i.e., the state in which the volume of the ink chamber is maintained at an intermediate level by means of the intermediate voltage Vm) is maintained over a long period of time. Accordingly, the vibration of the vibrating plate or the meniscus stemming from the previous expelling of ink droplets subsides sufficiently. During the current drive cycle, immediately before starting of the next drive cycle the voltage applied to the piezoelectric vibrator changes from the intermediate voltage Vm to the first drive voltage V1 while the vibration of the vibrating plate or the ink meniscus subsides sufficiently, thus diminishing the volume of the ink chamber. In this way, there are made preparations for expelling ink during the next drive cycle. Accordingly, when an attempt is made to expel ink droplets during the next drive cycle, the vibrating plate or the ink meniscus is in a vibrating state such as that shown in FIG. 9D. As can be seen from FIGS. 9A and 9B, the vibrating plate or the ink meniscus is in the same state as that in which ink droplets are continually expelled in the previous, current, and the next drive cycles. Therefore, so long as the vibrating plate or the ink meniscus is in such a vibrating state, since the vibrating state is analogous to that in which ink droplets are continually expelled, a stable drive operation can be ensured by bringing the movement of the piezoelectric vibrator in synchronization with the movement of the vibrating plate, even though the vibrating plate or the ink meniscus is not in a completely stationary state.

FIGS. 10 through 17 show the drive pulse signals PW produced according to the logic truth tables. A selection output signal SS which indicates whether or not the charge signals NCHG2, 3 are selected is also provided in FIGS. 10 through 17. The selection output signal SS corresponds to the logic truth table described by reference to FIGS. 8A and 8B. More specifically, the selection output signal SS corresponds to outputs (indicated by arrow A) from OR gates 258 and 259 of a circuit shown in FIG. 7.

Figure 10:
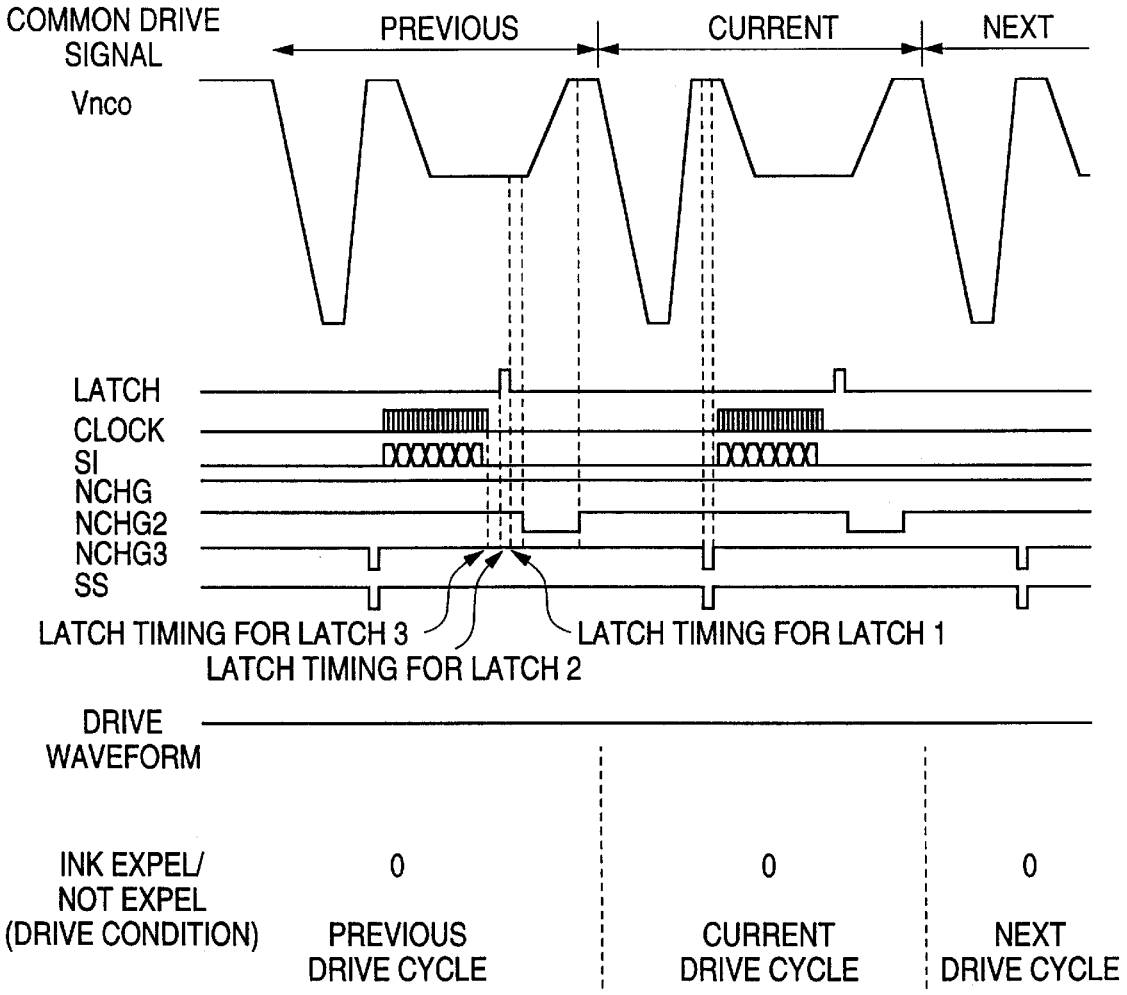
FIG. 10 is a schematic diagram for explaining a drive condition for the ink jet printer shown in FIG. 1.
Figure 11:
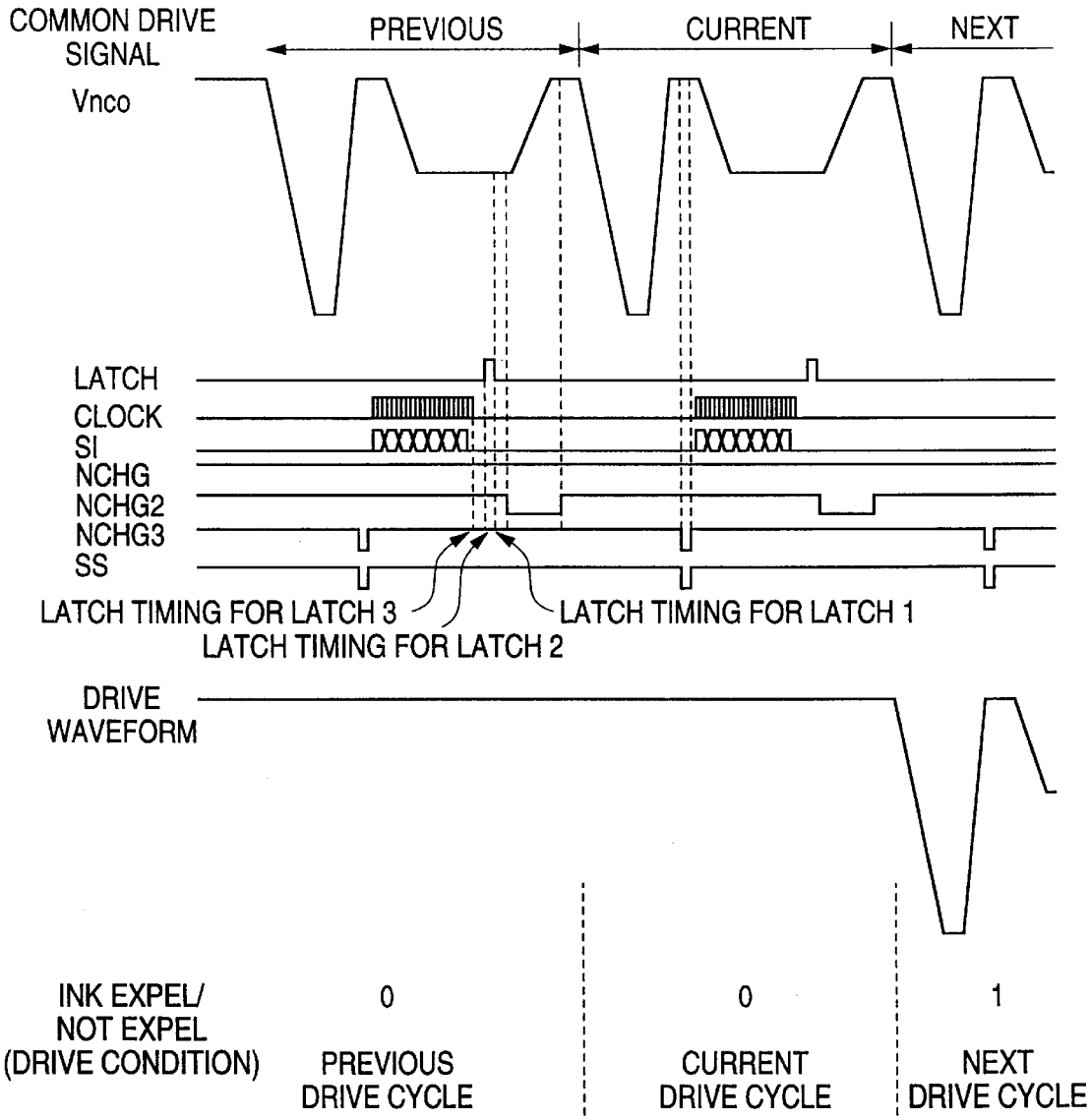
FIG. 11 is a schematic diagram for explaining a drive condition for the ink jet printer shown in FIG. 1.

As shown in FIGS. 10 and 11, in a case where under both the previous and current drive conditions ink is not expelled, at least until the current drive cycle there has already been performed a drive operation for causing subsidence of the vibration of the vibrating plate or the ink meniscus stemming from expelling of ink performed before the previous drive cycle, thus eliminating the need for an operation for causing subsidence of the vibration of the vibrating plate or the ink meniscus in the current drive cycle. Accordingly, since the charge signal NCHG3 is selected in each drive cycle by means of the selection output signal SS, the third drive voltage V3 is applied to the piezoelectric vibrator at the timing corresponding to the charge signal NCHG3 in each drive cycle. As a result, the volume of the ink chamber is maintained at a reduced volume. More specifically, as shown in FIG. 11, even in a case where ink droplets are expelled in the next drive cycle, preparations for expelling ink droplets are made in the current drive cycle. So long as ink droplets are expelled in a state in which the vibration of the vibrating plate or the ink meniscus subsides sufficiently, ink droplets can be expelled stably.

Figure 12:
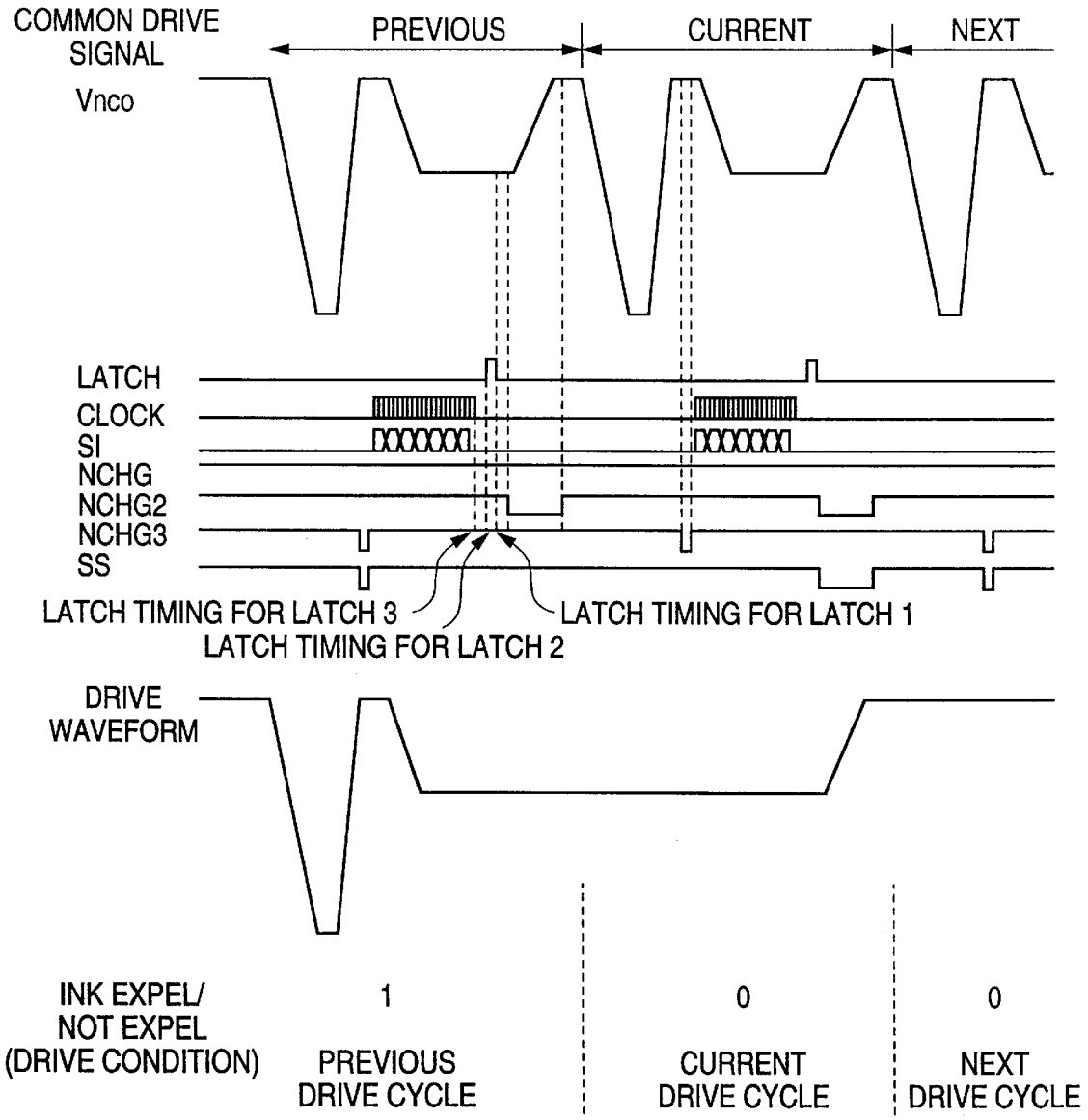
FIG. 12 is a schematic diagram for explaining the drive condition for the ink jet printer shown in FIG. 1.
Figure 13:
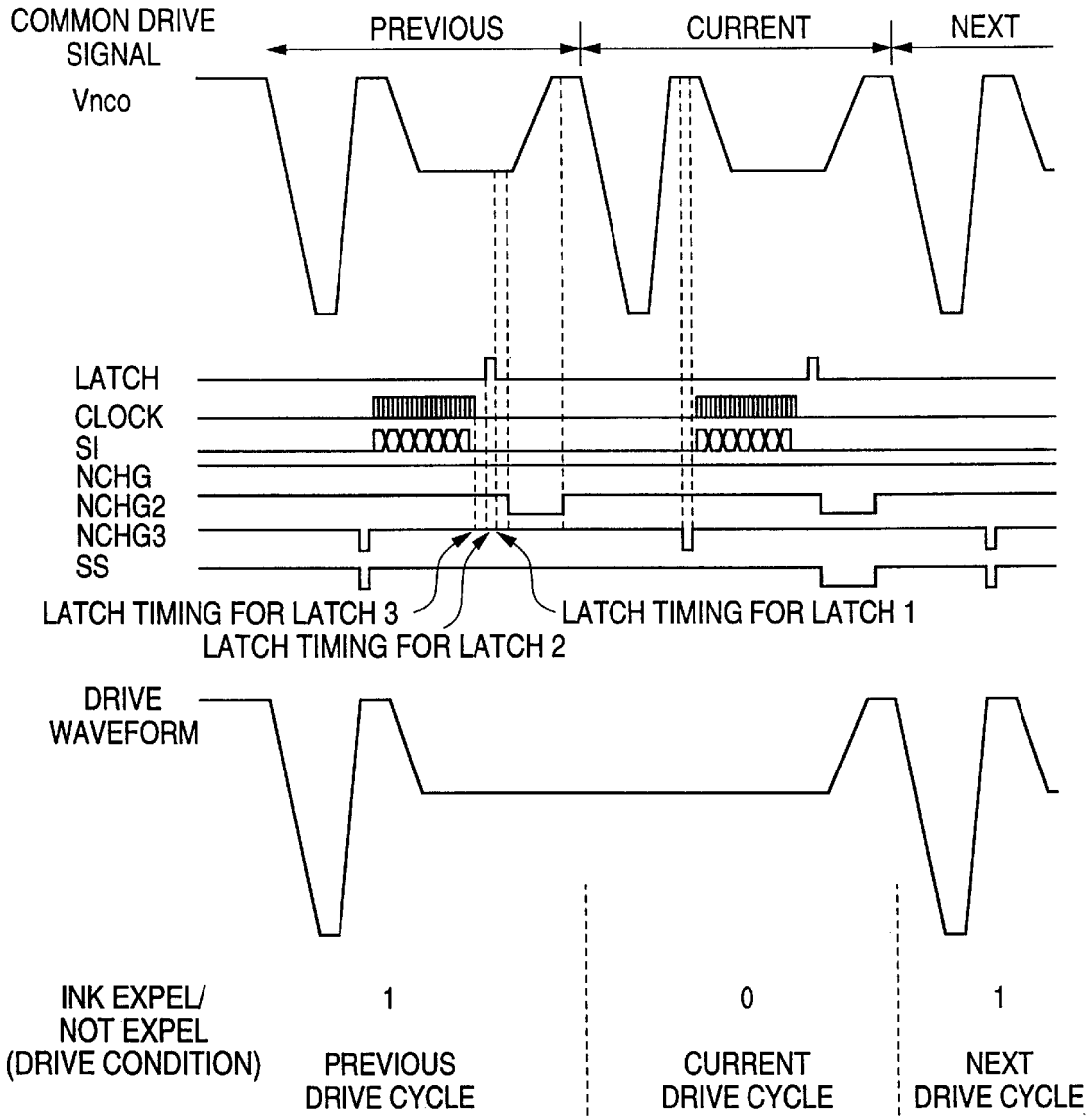
FIG. 13 is a schematic diagram for explaining the drive condition for the ink jet printer shown in FIG. 1.

Next, as shown in FIGS. 12 and 13, in a case where ink is expelled under the previous drive conditions and ink is not expelled under the current drive conditions, the charge signal NCHG2 is not selected by means of the selection output signal SS immediately before commencement of the current drive operation after expelling of ink droplets in the previous drive cycle. Accordingly, the first drive voltage V1 which causes the volume of the ink chamber to decrease is not applied even at the timing corresponding to the charge signal NCHG2. A signal having a drive waveform (i.e., the intermediate voltage Vm) which causes the volume of the ink chamber to be maintained at an intermediate volume is applied to the piezoelectric vibrator immediately before commencement of the current drive operation after expelling of ink droplets in the previous drive cycle. Accordingly, when the vibration of the vibrating plate or the ink meniscus stemming from expelling of ink droplets in the previous drive cycle finally attempts to subside, there is prevented application of a wasteful drive waveform which causes the volume of the ink chamber to decrease to the piezoelectric vibrator at the time of the previous drive operation or immediately before the current drive operation despite the fact that ink is not expelled under the current drive conditions. Therefore, there can be ensured a sufficient time to cause subsidence of the vibration of the vibrating plate or the ink meniscus stemming from expelling of ink droplets in the previous drive cycle. Further, since the charge signal NCHG3 is not selected by means of the selection output SS in the current drive cycle, the third drive voltage V3 which causes the volume of the ink chamber to decrease is not applied to the piezoelectric vibrator even at the timing corresponding to the charge signal NCHG3. After expelling of ink droplets in the previous drive cycle, the signal having a drive waveform which causes the volume of the ink chamber to be maintained at an intermediate level is continually applied to the piezoelectric vibrator even in the current drive cycle. Accordingly, when the vibration of the vibrating plate or the ink meniscus stemming from expelling of ink droplets in the previous drive cycle finally attempts to subside, there is prevented application of a wasteful drive waveform which causes the volume of the ink chamber to decrease to the piezoelectric vibrator in the first half of the current drive cycle despite the fact that ink is not expelled under the current drive conditions. Therefore, even in the current drive cycle there can be ensured a sufficient time to cause subsidence of the vibration of the vibrating plate or the ink meniscus stemming from expelling of ink droplets. As shown in FIG. 13, even in a case where ink droplets are expelled in the next drive cycle, there are made preparations for diminishing the volume of the ink chamber in a state in which the vibration of the vibrating plate or the ink meniscus subsides sufficiently in the first half of the current drive cycle. Accordingly, as in the case of continually expelling ink droplets, ink droplets can be stably expelled.

Figure 16:
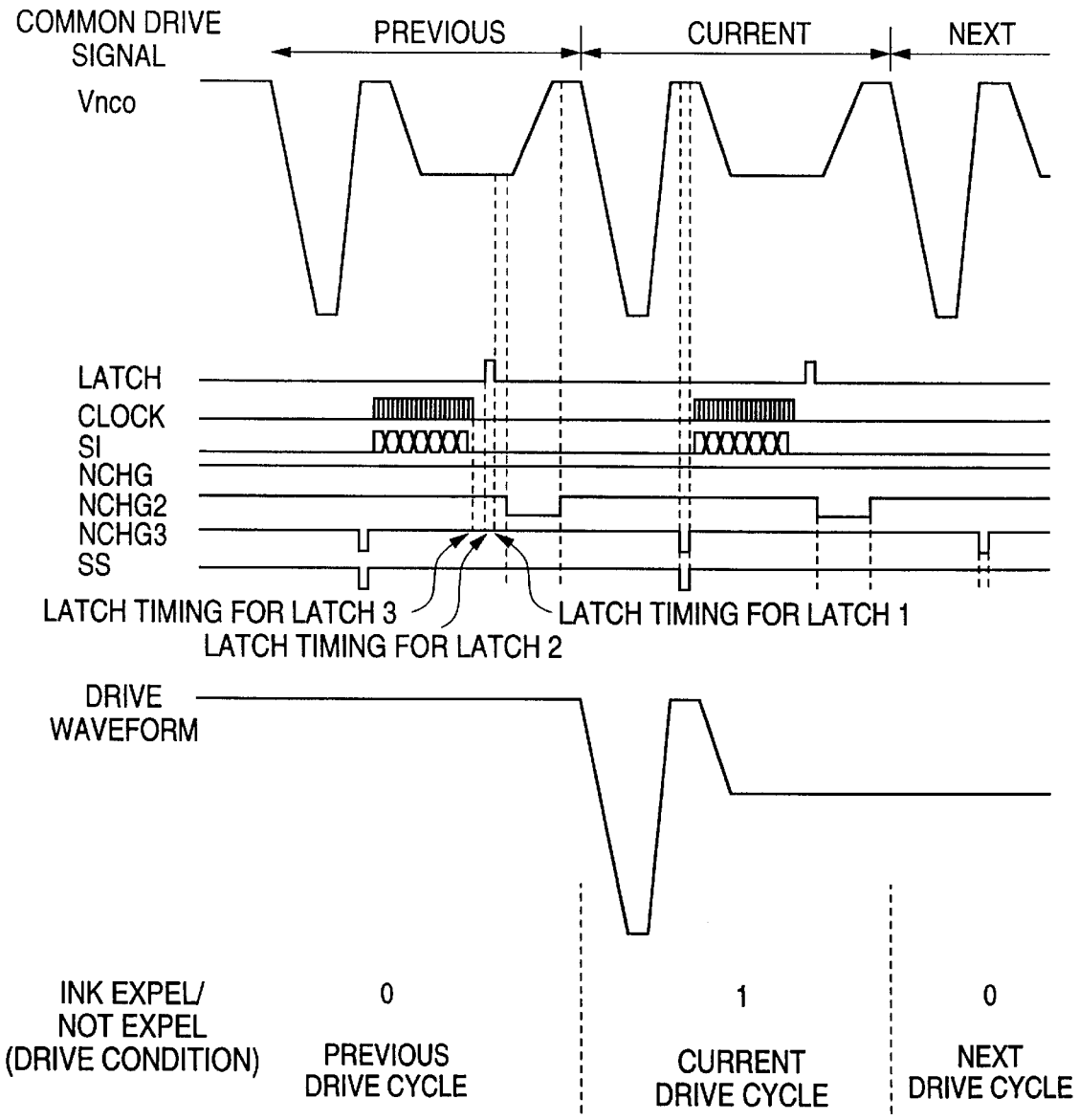
FIG. 16 is a schematic diagram for explaining the drive condition for the ink jet printer shown in FIG. 1.
Figure 17:
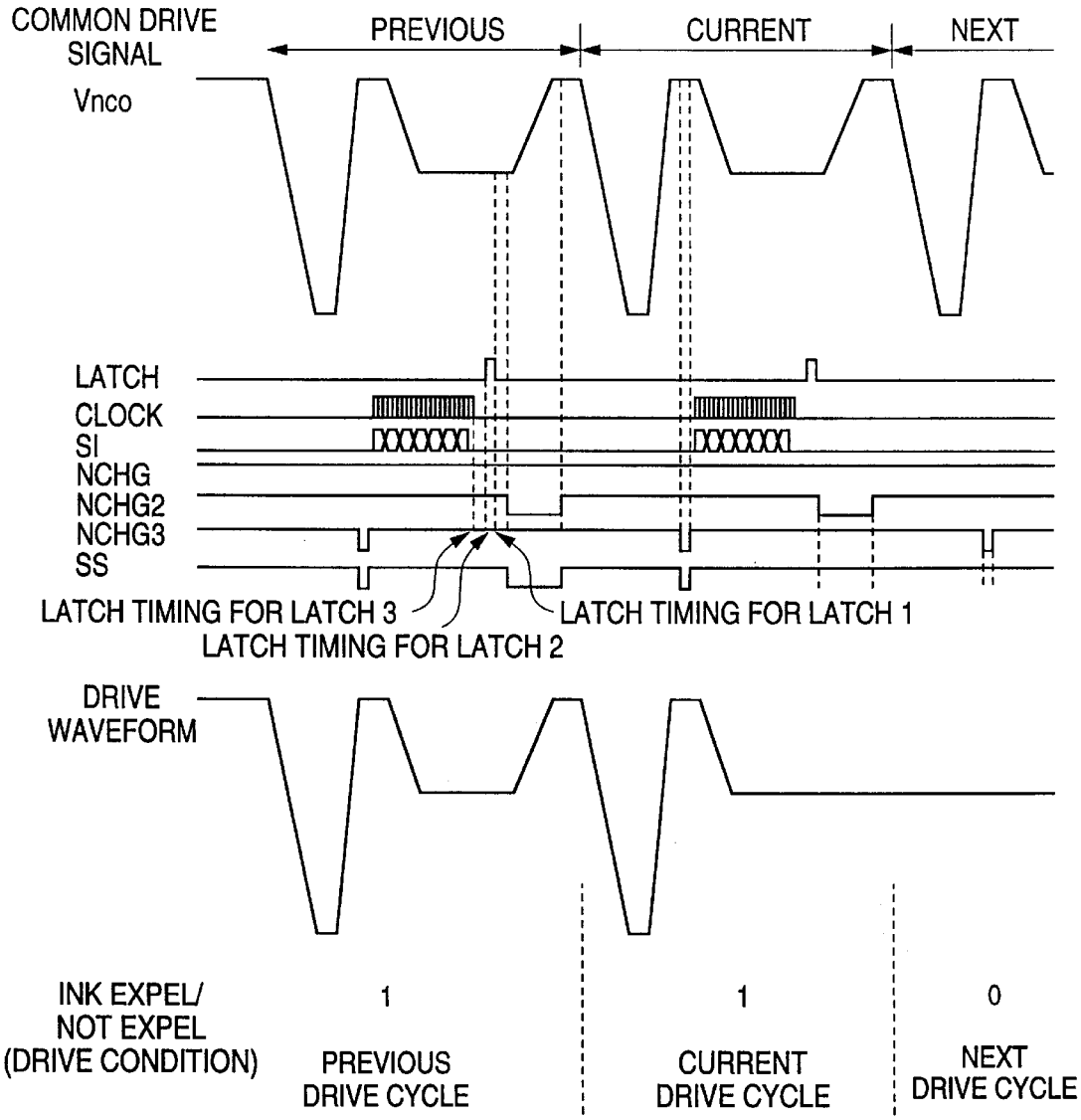
FIG. 17 is a schematic diagram for explaining the drive condition for the ink jet printer shown in FIG. 1.

As shown in FIGS. 16 and 17, in a case where ink is expelled under the current drive conditions and ink is not expelled under the next drive conditions, the charge signal NCHG2 is not selected by means of the selection output signal SS immediately before commencement of the next drive operation after expelling of ink droplets in the current drive cycle. Accordingly, the first drive voltage V1 which causes the volume of the ink chamber to decrease is not applied to the piezoelectric vibrator even at the timing corresponding to the charge signal NCHG2. Therefore, a signal having a drive waveform (i.e., the intermediate voltage Vm) which causes the volume of the ink chamber to be maintained at an intermediate volume is applied to the piezoelectric vibrator immediately before commencement of the next drive operation after expelling of ink droplets in the current drive cycle. Such a state is maintained for a predetermined period of time even in the next drive cycle.

Figure 14:
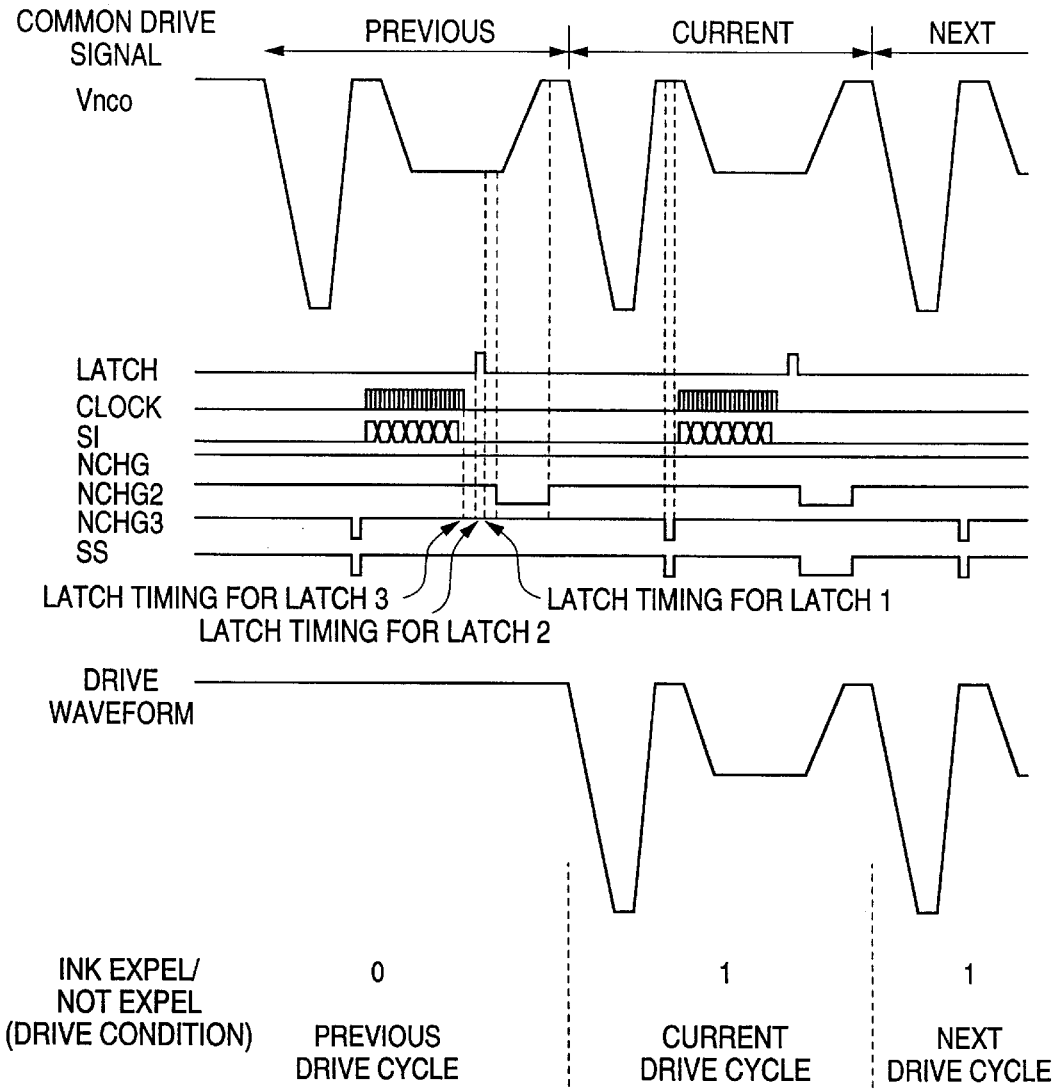
FIG. 14 is a schematic diagram for explaining the drive condition for the ink jet printer shown in FIG. 1.
Figure 15:
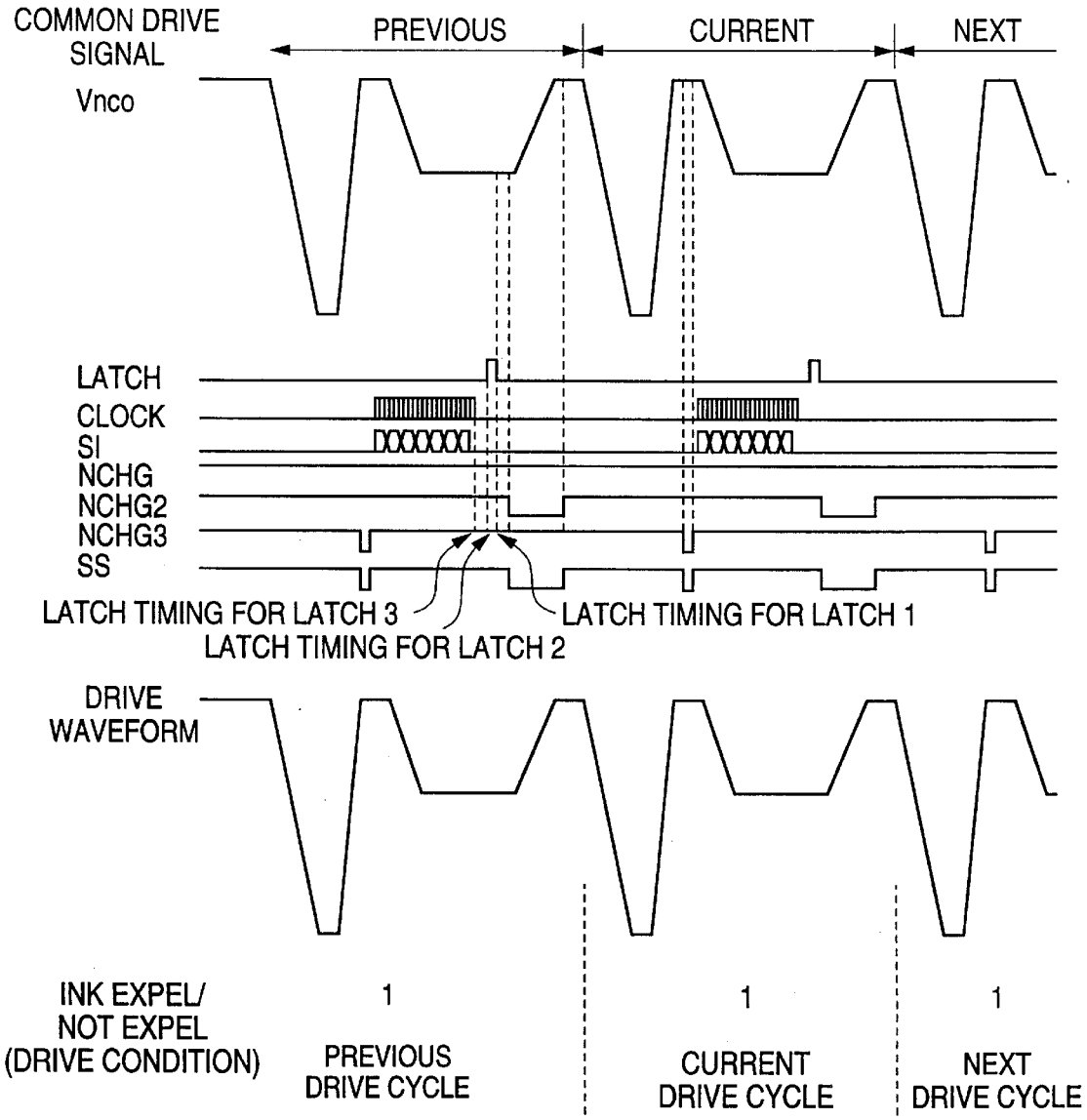
FIG. 15 is a schematic diagram for explaining the drive condition for the ink jet printer shown in FIG. 1.

As shown in FIGS. 14 and 15, in a case where ink is expelled under both the current and next drive conditions, the charge signal NCHG2 is selected by means of the selection output signal SS immediately before commencement of the next drive operation after expelling of ink droplets in the current drive cycle. Accordingly, the first drive voltage V1 which causes the volume of the ink chamber to decrease is applied to the piezoelectric vibrator at the timing corresponding to the charge signal NCHG2. Preparations for expelling ink droplets will be made in the next drive cycle after expelling of ink droplets in the current drive cycle. Since ink droplets are continually expelled in the current and next drive cycles under the foregoing conditions, the vibration of the vibrating plate or the ink meniscus is stable. The movement of the piezoelectric vibrator can be brought into synchronization with that of the vibrating plate or that of the ink meniscus in such a vibrating state, and hence ink droplets can be stably expelled in the next drive cycle even when the vibration of the vibrating plate or the ink meniscus does not subside completely.

As can be seen from a comparison between the timing chart provided in FIG. 15 and that provided in FIG. 16, in a case where ink is expelled under the current drive condition, the drive waveform applied to the piezoelectric vibrator is switched under the next drive condition immediately before commencement of the next drive operation. More specifically, as shown in FIG. 15, in a case where ink is expelled under both the current and next drive conditions, the charge signal NCHG2 is selected by means of the selection output signal SS immediately before commencement of the next drive operation after expelling of ink droplets in the current drive cycle. Accordingly, the first drive voltage V1 which causes the volume of the ink chamber to decrease is applied to the piezoelectric vibrator at the timing corresponding to the charge signal NCHG2. Preparations for expelling ink droplets in the next drive cycle are made after expelling of ink droplets in the current drive cycle. In contrast, as shown in FIG. 16, in a case where ink is expelled under the current drive condition and ink is not expelled under the next drive condition, the charge signal NCHG2 is not selected by means of the selection output signal SS immediately before commencement of the next drive operation after expelling of ink droplets in the current drive cycle. As a result, the intermediate voltage Vm which causes the volume of the ink chamber to be maintained at an intermediate level is applied to the piezoelectric vibrator even at the timing corresponding to the charge signal NCHG2. However, the first drive voltage V1 which causes the volume of the ink chamber to decrease is not applied to the piezoelectric vibrator. Therefore, to the piezoelectric vibrator there is applied a drive waveform which dampens the vibration of the vibrating plate or the ink meniscus stemming from expelling of ink droplets in the current drive cycle.

In contrast, as can be seen from a comparison between the timing chart provided in FIG. 11 and that provided in FIG. 12, in a case where ink is not expelled under the current drive condition, the drive waveform applied to the piezoelectric vibrator is switched under the previous drive condition immediately before commencement of the next drive operation. As shown in FIG. 11, in a case where under both the current and next drive conditions ink is not expelled, at least until the current drive cycle there has already been performed a drive operation for causing the subsidence of the vibration of the vibrating plate or the ink meniscus stemming from expelling of ink performed before the previous drive cycle, thus eliminating the need for an operation for causing the subsidence of the vibration of the vibrating plate or the ink meniscus in the current drive cycle. Accordingly, since the charge signal NCHG3 is selected in the current drive cycle by means of the selection output signal SS, the third drive voltage V3 is applied to the piezoelectric vibrator at the timing corresponding to the charge signal NCHG3 in each drive cycle. As a result, the volume of the ink chamber is maintained at a reduced volume. In contrast, as shown in FIG. 12, in a case where ink is not expelled under the current drive conditions and ink is expelled under the previous drive conditions, there is a need to cause subsidence of the vibration of the vibrating plate or the ink meniscus caused at the time of expelling of ink droplets in the previous drive cycle. For this reason, the charge signal NCHG3 is not selected by means of the selection output SS in the current drive cycle. Consequently, even in the current drive cycle there is maintained for a predetermined period of time the state in which a signal having a drive waveform (i.e., the intermediate voltage Vm) which causes the volume of the ink chamber to be maintained at an intermediate level is applied to the piezoelectric vibrator.

As mentioned above, since the ink-jet printer according to the present embodiment switches the current drive waveform to be supplied to a pressure generation element, on the basis of the previous, current, and next drive conditions, the vibrating state of the ink meniscus can be optimized by the time expelling of ink is commenced in the next drive cycle. Consequently, expelling of ink can always be commenced in a stable state, and hence there is no need for consumption of time to wait for the next expelling of ink until the vibration of the ink meniscus subsides sufficiently. Therefore, time intervals between ink expelling operations can be reduced, thus implementing high-speed printing operations.

Further, in the present embodiment, the charge signals NCHG2 and NCHG3 (timing signal) specify timing at which the first drive voltage V1 or the third drive voltage V3 which causes the volume of the ink chamber to decrease from its intermediate level is acquired from the drive signal Vnco and is selectively applied to a predetermined piezoelectric vibrator. The output control section 255 utilizes these signals as signals common among all the piezoelectric vibrators and controls the application of the first drive voltage V1 or the third drive voltage V3 to the individual piezoelectric vibrators according to whether the charge signal NCHG2 or the charge signal NCHG3 is selected. Consequently, there is no need to produce a signal for specifying timing at which the first drive voltage V1 or the third drive voltage V3 is applied to the piezoelectric vibrator for each piezoelectric vibrator, thus alleviating a load exerted on the drive circuit.

Another Embodiment

Figure 18:
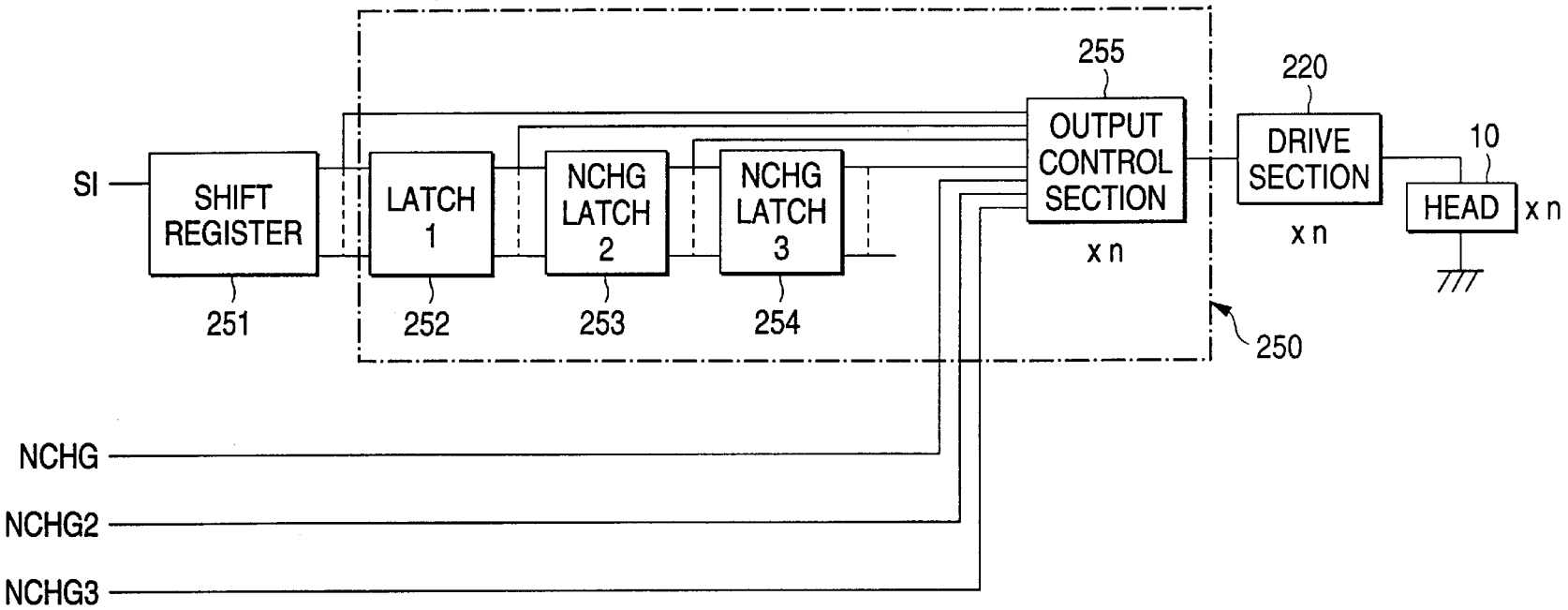
FIG. 18 is a block diagram showing the other embodiment of a history control section constituted in the control system of the ink jet printer shown in FIG. 1.
Figure 19:
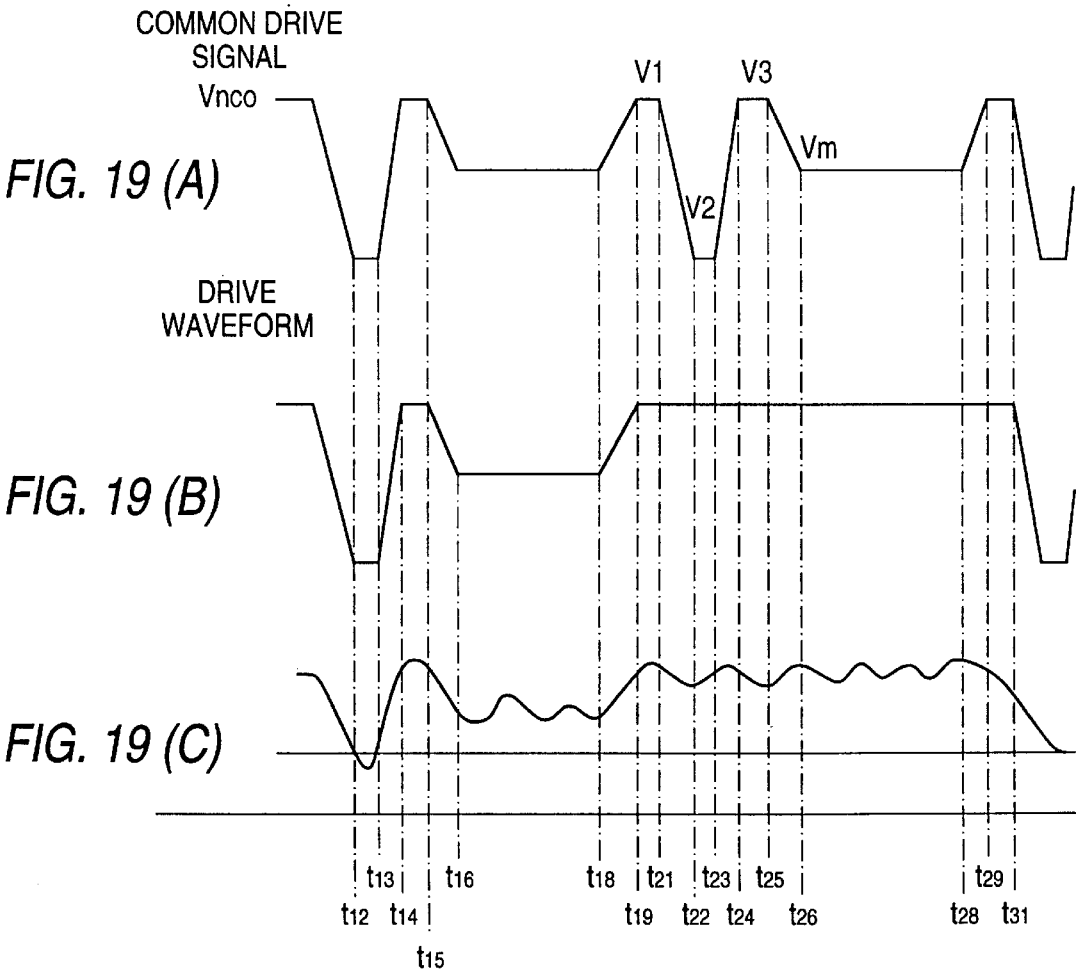
FIGS. 19(A)–(C) are schematic diagrams for explaining a problem of a conventional drive control method for an ink jet printer.

In the history control section 250 shown in FIG. 5, the second latch circuit 253 and the third latch circuit 254 are arranged so as to hold the current print data and the previous print data, respectively. However, as is obvious from the history control section 250 shown in FIG. 18, the second latch circuit 253 and the third latch circuit 254 may be arranged so as to record and hold binary signals "1" and "0" in the columns of the charge signals NCHG2 and NCHG3 shown in FIG. 8.

In terms of switching of the current drive conditions on the basis of a drive history, the present invention can be applied to the expelling of ink by an ink-jet head of catapult-like expelling type, as well as to the expelling of ink by an ink-jet head of pressurized expelling type. Further, the gist of the present invention may be applied to an ink-jet head which expels ink droplets by inducing a change in the volume of ink through use of a heating element.

As has been described, in an ink-jet printer according to the present invention, output control means switches the current drive waveform to be supplied to a pressure generation element, on the basis of the previous, current, and next drive conditions stored in data hold means, and hence the vibrating state of an ink meniscus is optimized until the next expelling of ink. Accordingly, expelling of ink can be commenced stably, hence eliminating a need for consumption of time to wait for the next expelling of ink until the vibration of the ink meniscus subsides sufficiently. Time intervals between ink expelling operations can be reduced, thus implementing high-speed printing operations.

What is claimed is:

1. An ink-jet recording apparatus comprising:

a plurality of pressure generation chambers formed in an ink-jet head;

a plurality of ink nozzles in communication with the individual pressure generation chambers;

pressure generation elements for constricting the pressure generation chambers to expel ink droplets from the ink nozzles in communication with the individual pressure generation chambers;

drive control means for controlling the expelling of ink droplets through application of a drive signal to the pressure generation elements, the drive control means including:

data hold means for holding previous, current, and next drive conditions of the pressure generation elements, and output control means for switching a current drive waveform to be supplied to the pressure generation elements, on the basis of the previous, current, and next drive conditions stored in the data hold means, at the time of current driving of the pressure generation elements, thereby optimizing a vibrating state of an ink meniscus and reducing a time interval before a next expelling of ink droplets.

2. The ink-jet recording apparatus as defined in claim 1, wherein the output control means switches, at the time of current drive operation, a waveform of a signal to be applied to the pressure generation elements for a predetermined period of time after completion of a previous drive operation on the basis of the previous and current drive conditions stored in the data hold means, and switches the current drive waveform to be supplied to the pressure generation elements with regard to the waveform of the signal applied to the pressure generation elements immediately before commencement of the next drive operation, on the basis of the previous and current drive conditions stored in the data hold means or on the basis of the current and next drive conditions stored in the data hold means.

3. The ink-jet recording apparatus as defined in claim 1, wherein the output control means drives the pressure generation elements so as to increase the volume of the pressure generation chambers when the volume of the pressure generation chambers is in a reduced state; drives the pressure generation elements so as to reduce the volume of the pressure generation chambers, thus causing ink nozzles to expel ink droplets; and drives the pressure generation elements so as to maintain the volume of the pressure generation chambers in an intermediate state, and wherein in a case where ink is not expelled during the next drive operation, a waveform signal, which causes the volume of the pressure generation chambers to be maintained at the intermediate state, is applied to the pressure generation elements during the current drive operation immediately before commencement of the next drive operation.

4. The ink-jet recording apparatus as defined in claim 3, wherein in a case where ink is expelled during the previous drive operation and ink is not expelled during the current drive operation, during the current operation the output control means applies to the pressure generation elements a signal having a waveform which maintains the volume of the pressure generation chambers in the intermediate state for a given period of time after completion of the previous drive operation.

5. The ink-jet recording apparatus as defined in claim 4, wherein in a case where ink is expelled during the previous drive operation and ink is not expelled during the current drive operation, during the current operation the output control means applies to the pressure generation elements a signal having a waveform which maintains the volume of the pressure generation chambers in the intermediate state for a given period of time after completion of the previous drive operation and diminishes the volume of the pressure generation chambers immediately before commencement of the next drive operation.

6. The ink-jet recording apparatus as defined in claim 3, wherein in a case where ink is expelled during the current drive operation and ink is not expelled during the next drive operation, the output control means applies to the pressure generation elements a signal having a waveform which causes the volume of the pressure generation chambers to diminish immediately before commencement of the next drive operation.

7. The ink-jet recording apparatus as defined in claim 3, wherein the voltage applied to the pressure generation elements at the commencement of a drive operation during a drive cycle in order to reduce the volume of the pressure generation chambers equals the voltage applied in order to diminish the volume of the pressure generation chambers for the purpose of expelling ink droplets.

8. The ink-jet recording apparatus as defined in claim 1, wherein the output control means uses a timing signal for specifying timing at which there is applied a signal for causing the volume of the pressure generation chambers to diminish and controls application of a signal which causes a reduction in the volume of the pressure generation chambers to the pressure generation elements according to whether or not the timing signal is selected.

9. The ink-jet recording apparatus as defined in claim 1, wherein the pressure generation elements are piezoelectric elements.

10. A method for driving an ink-jet recording apparatus including a plurality of pressure generation chambers and a plurality of ink nozzles in communication with the individual pressure generation chambers, comprising;

constricting the pressure generation chambers, which are formed in an ink-jet head, to expel ink droplets from the ink nozzles in communication with the individual pressure generation chambers;

controlling the expelling of ink droplets through application of a drive signal to pressure generation elements;

holding previous, current, and next drive conditions of the pressure generation elements, and switching a current drive waveform to be supplied to the pressure generation elements, on the basis of the previous, current, and next drive conditions, at the time of current driving of the pressure generation elements, thereby optimizing a vibrating state of an ink meniscus and reducing a time interval before a next expelling of ink droplets.

11. An ink-jet recording apparatus comprising:

a plurality of pressure generation chambers formed in an ink-jet head;

a plurality of ink nozzles in communication with the individual pressure generation chambers;

pressure generation elements for constricting the pressure generation chambers to expel ink droplets from the ink nozzles in communication with the individual pressure generation chambers;

drive controller for controlling the expelling of ink droplets through application of a drive signal to the pressure generation elements, the drive controller including:

data holder for holding previous, current, and next drive conditions of the pressure generation elements, and output controller for switching a current drive waveform to be supplied to the pressure generation elements, on the basis of the previous, current, and next drive conditions stored in the data holder, at the time of current driving of the pressure generation elements, thereby optimizing a vibrating state of an ink meniscus and reducing a time interval before a next expelling of ink droplets.

12. The inkjet recording apparatus as defined in claim 11, wherein the output controller switches, at the time of current drive operation, a waveform of a signal to be applied to the pressure generation elements for a predetermined period of time after completion of a previous drive operation on the basis of the previous and current drive conditions stored in the data holder, and switches the current drive waveform to be supplied to the pressure generation elements with regard to the waveform of the signal applied to the pressure generation elements immediately before commencement of the next drive operation, on the basis of the previous and current drive conditions stored in the data holder or on the basis of the current and next drive conditions stored in the data holder.

13. The ink-jet recording apparatus as defined in claim 11, wherein the output controller drives the pressure generation elements so as to increase the volume of the pressure generation chambers when the volume of the pressure generation chambers is in a reduced state; drives the pressure generation elements so as to reduce the volume of the pressure generation chambers, thus causing ink nozzles to expel ink droplets, and drives the pressure generation elements so as to maintain the volume of the pressure generation chamber in an intermediate state, and wherein in a case where ink is not expelled during the next drive operation, a waveform signal, which causes the volume of the pressure generation chambers to be maintained at the intermediate state, is applied to the pressure generation elements during the current drive operation immediately before commencement of the next drive operation.

14. The ink-jet recording apparatus as defined in claim 13, wherein in a case where ink is expelled during the previous drive operation and ink is not expelled during the current drive operation, during the current operation the output controller applies to the pressure generation elements a signal having a waveform which maintains the volume of the pressure generation chambers in the intermediate state for a given period of time after completion of the previous drive operation.

15. The ink-jet head recording apparatus as defined in claim 14, wherein in a case where ink is expelled during the previous drive operation and ink is not expelled during the current drive operation, during the current operation the output controller applies to the pressure generation elements a signal having a waveform which maintains the volume of the pressure generation chambers in the intermediate state for a given period of time after completion of the previous drive operation and diminishes the volume of the pressure generation chambers immediately before commencement of the next drive operation.

16. The ink-jet recording apparatus as defined in claim 13, wherein in a case where ink is expelled during the current drive operation and ink is not expelled during the next drive operation, the output controller applies to the pressure generation elements a signal having a waveform which causes the volume of the pressure generation chambers to diminish immediately before commencement of the next drive operation.

17. The ink-jet recording apparatus as defined in claim 13, wherein the voltage applied to the pressure generation elements at the commencement of a drive operation during a drive cycle in order to reduce the volume of the pressure generation chambers equals the voltage applied in order to diminish the volume of the pressure generation chambers for the purpose of expelling ink droplets.

18. The ink-jet recording apparatus as defined in claim 11, wherein the output controller uses a timing signal for specifying timing at which there is applied a signal for causing the volume of the pressure generation chambers to diminish and controls application of a signal which causes a reduction in the volume of the pressure generation chambers to the pressure generation elements according to whether or not the timing signal is selected.

19. The ink-jet recording apparatus as defined in claim 11, wherein the pressure generation elements are piezoelectric.

* * * * *